US007059965B2

(12) United States Patent
Jackson

(10) Patent No.: US 7,059,965 B2
(45) Date of Patent: Jun. 13, 2006

(54) POKER GAME WITH A RANK ADVANCING LADDER

(75) Inventor: Kathleen Nylund Jackson, Scituate, MA (US)

(73) Assignee: Precedent Gaming, Incorporated, Scituate, MA (US)

( * ) Notice: Subject to any disclaimer, the term of this patent is extended or adjusted under 35 U.S.C. 154(b) by 52 days.

(21) Appl. No.: 10/821,637

(22) Filed: Apr. 9, 2004

(65) Prior Publication Data

US 2005/0110215 A1 May 26, 2005

Related U.S. Application Data

(60) Provisional application No. 60/525,324, filed on Nov. 26, 2003.

(51) Int. Cl.
*A63F 9/24* (2006.01)

(52) U.S. Cl. ..... 463/16; 273/292; 463/13; 463/20

(58) Field of Classification Search ..... 273/292; 463/20, 13, 16
See application file for complete search history.

(56) References Cited

U.S. PATENT DOCUMENTS

| | | | | |
|---|---|---|---|---|
| 4,743,022 A | | 5/1988 | Wood | 463/13 |
| 5,294,120 A | | 3/1994 | Schultz | 463/13 |
| 5,356,140 A | | 10/1994 | Dabrowski et al. | 463/12 |
| 5,486,005 A | | 1/1996 | Neal | 273/292 |
| 5,531,440 A | * | 7/1996 | Dabrowski et al. | 463/12 |
| 5,570,885 A | | 11/1996 | Ornstein | 463/27 |
| 5,639,092 A | | 6/1997 | Macaisa | 273/292 |
| 5,718,431 A | | 2/1998 | Ornstein | 273/292 |
| 5,732,949 A | * | 3/1998 | Josephs | 273/292 |
| 5,795,225 A | * | 8/1998 | Jones et al. | 463/13 |
| 5,823,873 A | | 10/1998 | Moody | 463/13 |
| 5,868,618 A | | 2/1999 | Netley et al. | 463/13 |
| 5,882,260 A | | 3/1999 | Marks et al. | 463/13 |
| 5,988,643 A | | 11/1999 | Awada | 273/92 |
| 6,007,066 A | | 12/1999 | Moody | 273/292 |
| 6,019,374 A | * | 2/2000 | Breeding | 273/292 |
| 6,227,969 B1 | * | 5/2001 | Yoseloff | 463/13 |
| 6,311,976 B1 | * | 11/2001 | Yoseloff et al. | 273/138.2 |
| 6,312,334 B1 | | 11/2001 | Yoseloff | 463/25 |
| 6,334,613 B1 | | 1/2002 | Yoseloff | 273/292 |
| 6,435,509 B1 | * | 8/2002 | Wichinsky et al. | 273/292 |
| 6,481,717 B1 | * | 11/2002 | Richardelle | 273/292 |
| 6,612,927 B1 | * | 9/2003 | Slomiany et al. | 463/16 |
| 6,638,163 B1 | | 10/2003 | Moody | 463/13 |
| 6,652,378 B1 | * | 11/2003 | Cannon et al. | 463/20 |
| 6,669,198 B1 | * | 12/2003 | Wichinsky | 273/292 |
| 6,679,492 B1 | | 1/2004 | Markowiak | 273/138.1 |

(Continued)

*Primary Examiner*—Eugene Kim
*Assistant Examiner*—Dolores R. Collins
(74) *Attorney, Agent, or Firm*—Mark A. Litman & Associates, P.A.

(57) ABSTRACT

A video wagering game is played by placing at least one bet; receiving a first set of symbols from which a rank may be determined in reading the symbols; determining the rank of the first set of symbols as a first rank; receiving at least a second set of symbols from which a rank may be determined in reading the symbols; determining the rank of the second set of symbols; comparing the rank of the second set of symbols to the rank of the second set of symbols; determining whether the rank of said second set of symbols ties or exceeds the first rank; and resolving the at least one bet with respect to whether the second rank ties or exceeds the first rank.

16 Claims, 23 Drawing Sheets

U.S. PATENT DOCUMENTS

| | | | | |
|---|---|---|---|---|
| 6,708,975 | B1 * | 3/2004 | Fox et al. | 273/292 |
| 6,752,394 | B1 * | 6/2004 | Malcolm | 273/292 |
| 6,776,416 | B1 * | 8/2004 | Jackson | 273/292 |
| 6,860,810 | B1 * | 3/2005 | Cannon et al. | 463/20 |
| 6,869,074 | B1 * | 3/2005 | Miller | 273/292 |
| 6,871,856 | B1 * | 3/2005 | Rozboril | 273/292 |
| 6,913,531 | B1 * | 7/2005 | Yoseloff | 463/13 |
| 6,926,607 | B1 * | 8/2005 | Slomiany et al. | 463/20 |
| 2003/0027626 | A1 * | 2/2003 | Marks et al. | 463/20 |
| 2003/0134673 | A1 * | 7/2003 | Moody | 463/20 |
| 2004/0002376 | A1 * | 1/2004 | Swift et al. | 463/25 |
| 2004/0017043 | A1 | 1/2004 | Moody | |

* cited by examiner

POKER GAME WITH A RANK ADVANCING LADDER

This application claims the benefit of Provisional Application No. 60/523,324 filed Nov. 26, 2003.

BACKGROUND OF THE INVENTION

1. Field of the Invention

The present invention relates to a poker game suitable for use in casinos and other gaming establishments as a casino table poker game particularly in a version as an electronic poker game such as a video poker. The invention further relates to video gaming play where multiple sequences of hand plays within a progressing ladder of ranks within a game may be allowed with enhanced payouts for consecutive wins.

2. Background of the Art

Games based upon variations of poker have attained enormous popularity as casino-type entertainment games, particularly in the past twenty years. The success of poker games in the gaming industry is partially based on the game's simplicity (i.e., there is widespread public knowledge of the game rules) and the fact that players feel more directly involved in exercising judgment in the play of the game. Furthermore, the technological innovations in computer gaming equipment allow for reasonably fair odds being provided to the draw poker player. Payouts are typically around 93–95%, and some casinos assert higher levels of payouts. The steady generation of revenue provided to casinos by the various poker games contribute to the game's popularity with casinos.

One possible limitation to a still broader expansion of poker in casino operations may be the relatively low hit frequency of the highest ranked reward, the Royal Flush (approximately every 40,000 hands), when compared to the apparent frequency of slot machine jackpots. Additionally, in many poker games, the most frequent events will be a push (e.g., a win that is equivalent to the amount of the original wager) or a loss of the initial wager. Although the addition of wild cards can increase the frequency of winning outcomes and increase the relatively high apparent rank of hands, the win or payouts will normally begin at a higher rank of hand (e.g., at least three-of-a-kind in some wild card games) and the amount of the payout (as a factor of the original wager) will usually decrease with respect to each rank of hand. For example, in five card draw poker (with no wild cards) as compared to five card draw with one rank of card (e.g., deuces) wild, some comparative payouts would include:

| Hand | No Wild Cards | Wild Cards |
|---|---|---|
| Two pair | 2× | 0 |
| Three-of-a-Kind | 3× | 1× |
| Straight | 4× | 2× |
| Flush | 5× | 3× |
| Full House | 8× | 5× |

and the like. The satisfaction of an increased frequency of higher ranked hands is diminished by the reduced payouts for those higher ranked hands.

Many variations of poker and especially draw poker have been developed for casino table games and for video games. Each of these game variations features its own set of rules and/or optimal player strategy. Some game variations attempt to increase the total game outputs and are represented by games such as "Deuces Wild Poker," "Joker Wild Poker," "Bonus Poker," "Double Bonus Poker," "Second Chance Poker," etc. Some games appeal to players by raising the payout percentage to 97% and even higher through an approach of providing bonuses for certain types of winning hands, such as Four of a Kind of Aces, Four of a Kind of Twos, Four of Kind of Threes, etc., as in Bonus Poker and Double Bonus Poker.

Another way in which casinos and gaming equipment manufacturers have attempted to increase the enjoyment and length of time that players spend at the gaming equipment is to add variety to not only the types of games played, but also to the format and strategy of the games played. For example, U.S. Pat. No. 5,356,140 describes a game called Double Play poker in which a player is dealt two five card hands face up. The Player elects one of the hands to be played, and the winning outcome is based upon the play of the single hand chosen. Only one hand can be chosen for play. While this game allows the player to select or play from one of two hands, it does not maintain the other hand in the game, and it does not allow another player to select the other hand.

U.S. Pat. No. 5,868,618 relates to a multi-tier video poker game method including the step of receiving payment from an individual and randomly dealing a first tier poker hand on a video screen observable by the individual. The method additionally includes enabling the individual to play the first tier poker hand in consideration for said payment. Criteria are established for a winning hand and the individual is awarded a payment credit if the first tier poker hand played by the individual meets or exceeds the criteria for a winning hand. The method further includes the step of enabling the individual to selectively either accept payment in an amount equal to or less than the payment credit or to wager the amount on a second tier poker hand to be displayed on the video screen.

U.S. Pat. No. 5,486,005 describes a game that requires each player to make a bet or wager to participate in a round dealt by the dealer. After each player makes a wager, the dealer deals a predetermined like number of initial cards from a standard deck of fifty-two playing cards to a predetermined number of hands. These cards are preferably dealt face up showing the value of each card. The preferred embodiment of the present invention calls for four initial cards to be dealt face up to seven hands; however, the number of initial cards dealt and the number of hands could vary. After the initial cards are dealt, the dealer places odds on each hand according to predetermined guidelines set by the house. An option, if desired by the house, allows the dealer to select two or more of the hands for combination as a field position. The rules allow the player to select a field position to play instead of his hand. If a player chooses the field position instead of one of the hands, and either of the hands selected as part of the field position wins, then the player wins. The odds for winning the field position may be the odds previously selected for each hand or may be new odds placed on the field position by the dealer. After the dealer selects the odds for each hand, and the field position is being utilized, each player selects one of the hands, the field position, or a no-two-pair-or-better position. The no-two-pair-or-better position, which may also be referred to as a no-hand winning position, requires that none of the hands, after all the cards are dealt, have two pairs or better according to the conventional rules of Poker. The conventional rules of Poker set the order of hands in descending order as follows: Straight Flush, Four of a Kind, Full House, Flush, Straight, Three of a Kind, Two Pairs, a Pair, and Highest card.

U.S. Pat. No. 5,486,005 describes a method and apparatus for playing a poker like game in which distinct hands are dealt to the table and the dealer. Individual players may wager on particular hands (against the dealer or for attaining a minimum predetermined rank). Additionally, there are table odds for events evaluating a multiplicity of the hands (e.g., 6:1 odds for no players' hand having two pair or better).

U.S. Pat. No. 5,718,431 describes a method of playing a casino game (including table and video games in U.S. Pat. Nos. 5,570,885 and 5,823,873) wherein increased payouts are achieved by attaining predetermined numbers of consecutive wins at a game of chance, including poker, craps, baccarat, blackjack, etc. Streaks are identified by the dealer, as with a marker. An enhanced payout is achieved with an initial side bet by the player. The game is played in a fairly complex manner comprising the steps of:

(a) providing a conventional game receiving region and a plurality of consecutive win chip receiving regions for the player, each such region identifying a number of consecutive wins starting with the number two and up to a maximum number of chip receiving regions permitted by rules of the game;

(b) the player making a conventional bet of a denomination within the denomination range permitted by rules of the game;

(c) the player making a bet on the occurrence of a predetermined number of consecutive wins by placing the bet in one of a predetermined group of consecutive win bet receiving regions for use by the player, each bet receiving region representing a different number of consecutive wins, the bet being of a denomination permitted by rules of the game;

(d) playing the game of chance;

(e) deciding the winner of the game in accordance with conventional rules of the game;

(f) providing a streak chip for use in monitoring a number of consecutive wins made by the player;

(g) placing the streak chip upon the chip receiving region identifying two consecutive wins to be attempted when the player has won the first game;

(h) repeating step (b) preparatory to the play of the second game;

(i) repeating steps (d) and (e) during the play of each succeeding game;

(j) transferring the streak chip to successively higher numbered consecutive wins bet receiving regions until the streak chip is placed upon the consecutive win bet receiving area in which the consecutive win bet was originally placed; and (k) paying a player an amount equal to the denomination of the consecutive wins bet made by the player at step (c) multiplied by the odds for the consecutive wins selected when the player wins a game following step (j). This procedure is complicated, there are too many aspects that are capable of manipulation and fraud, and there are too many variable odds without a clear and automatic determination of the end of the game.

U.S. Pat. No. 5,882,260 describes a modified poker card game for a computer system in which "Bingo Poker" is played (it actually appears slightly more like "Domino Poker"). Individual cards are chosen and then positioned along a grid of multiple hands. The relevant feature is that the method includes "comparing individual hands . . . to corresponding values in a predetermined winning schedule . . . and awarding the player . . . responsive to the total value." The actual hands are not compared, however, nor increases in factors awarded for at least a certain number of hands exceeding a specific predetermined value.

U.S. Pat. No. 5,294,120 describes a video draw poker game in which a player commits to a certain number of replacement cards before viewing a hand. The number of cards drawn may be altered, along with alteration of the payout, after viewing of the hand. The play is of interest because this is a significant deviation from normal strategy, and the strategy of the play of the game must be effected before the hand is viewed. This could lead to significant disappointment in the play of the game, as where cards must be replaced with a winning hand, and the replacement destroys or lowers the rank of the winning hand.

U.S. Pat. No. 4,743,022 in effect describes a single card draw, five card poker game, in which a five card hand is dealt, and the hand may be altered by drawing a sixth card (only). The draw of a sixth card alters the pay table.

U.S. Pat. No. 6,007,066 describes a game in which a base poker hand may be provided on the screen a multiple number of times (e.g., the same original five card poker hand being shown up to 100 times on a video screen). The player elects to replace specific cards from the base hand, and each hand is randomly dealt from a separate deck, replacement cards for the discarded cards. Each hand is evaluated with respect to the rank of that hand, and individual payouts are made for each hand according to a predetermined paytable by rank and the total sum of individual hand payouts is credited to the player. In essence, a single hand may be played up to 100 times at the same time on a single screen. There is no interactive payout when identical hands or significant numbers of highly ranked hands occur.

Numerous patents also show poker being an alternative or contemporaneous game with other casino games (e.g., U.S. Pat. Nos. 5,988,643; 5,639,092.), but with no interactive payout when hands of a particular poker rank and hands of a specific value (e.g., a blackjack) are achieved at the same time or consecutively.

Heretofore it has been well known to play a variety of different games with a standard deck of fifty-two playing cards, including Blackjack, Poker, Bridge, Gin Rummy, etc. Games such as Blackjack are universally played in casinos and other such establishments because each player plays against the dealer or house and because they provide an edge to the dealer or house. Likewise, video draw poker machines in which a player individually plays against the house are widely found in casinos. In the video draw poker games there is an advantage to the house because the player needs a hand having a pair of Jacks or better to win. Other poker games, such as Seven-Card Stud, are not generally played in casinos because the rules of Poker require players to play against each other instead of each player playing against a single dealer or the house. The casinos are thus unable to profit from running such games. Moreover, in some poker games each player has one hand even though some variations allow the players to share certain cards. This limits the excitement of such games especially when a player initially receives a poor or relatively low ranked hand. Accordingly, there is a need for an exciting poker-like game in which each player has the opportunity to win larger payouts within the play of a game, even with hands of intermediate winning ranks.

U.S. Pat. No. 6,612,927 (Titled MULTI-STAGE MULTI-BET GAME, GAMING DEVICE AND METHOD, Slomiany) discloses a game comprised of a plurality of stages.

Each operation of the game begins with the operation of a first stage. Depending on the outcome of the first stage the game may be over, or there may be an operation of a second stage. Depending on the outcome of the second stage, the game may be over or there may be an operation of another stage. This sequence continues until the game ends or until the final (nth) stage has been operated, at which time the game ends. Wagers are made on successive stages of the multi-stage game. Each stage of the game may typically have its own paytable or payout scheme, and its own expected return. A bet made on a stage of the game which is not played is lost in the preferred form of the invention. One embodiment is a three stage, multi-line, multi-coin video slot machine. The same game format (slots) with the same paytable is operated on three stages, with increasing payout multipliers at each stage providing an increasing amount to win at the higher stages. The "spin" at each stage is independent of the previous stages. The second embodiment is a multi-stage Five-Card Stud poker game. Each stage is again independent of the previous stage. A variation of this game is also shown which uses the same paytable on each stage, but combined with a mechanism to increase the "hit" rate. A third embodiment is a Draw poker game that combines the concepts of the Stud poker embodiment with the decisions and optimal play analysis that are integral to Draw poker. The fourth embodiment is a dice game which has been adapted to provide a high dependency between the first stage and the next stages.

U.S. Pat. No. 6,638,163 (Moody) discloses a game in which the player makes a wager and is dealt a five card poker hand. The player wins or loses depending on the poker hand ranking of the hand. If the player has achieved a winning poker hand combination, the player is paid according to the pay table and the player plays again for no additional wager. The player is dealt a new five card hand and the poker hand ranking of this new five card is determined. If the player has a losing hand, the game is over. If the player has a winning hand, the player is paid according to the pay table and the player receives yet another five card for no additional wager. This continues until the player receives a losing hand. The method of play can also be applied to multiple hands.

U.S. Pat. No. 6,679,492 (Markowiak) discloses a method of playing a betting game using a special payoff table is utilized. Winning a round of play entitles players to the predetermined payoff. The payoff tables are carefully constructed to accommodate enhanced payoffs. Players are offered jackpots for winning consecutive rounds of play in games that previously did not offered it. Special bonuses are offered for arrangements specific to the particular game, thus interest of the desired outcomes is broadened. Players that won at least one round of play but then lose, trying to obtain number of consecutive wins that would qualify them for a jackpot, still receive a reward. The house edge changes from round to round, and favors players continuing betting after their wins. This method of playing can be used as the main betting system or as a side bet. The game is played by wagering on the outcomes of one or more played primary wagering games comprising the steps of: a) accepting a primary game wager according to conventional rules of the primary wagering game; b) accepting a separate wager to be resolved once a primary wagering game loss occurs, said separate wager resulting in a player reward as long as one primary game win is realized; c) conducting a round of the primary wagering game such that a win or loss is determined; d) should play of the primary wagering game result in a loss, collecting said primary game wager and said separate wager; e) should play of the primary wagering game result in a win, paying said player according to a payout table related to the primary wagering game; f) repeating steps a, c and d until a primary wagering game loss occurs; and g) then rewarding said player based on the separate wager according to a pay table related to one or more consecutive primary wagering game wins realized by said player prior to the primary wagering game loss.

U.S. Pat. No. 6,334,613 (Yoseloff) describes a game including the play of a hand of poker (either as a casino table card game or a video gaming apparatus or computer game). A partial hand is provided to a player after an initial wager. The actual hand of poker involves the potential for at least two distinct games of poker being playable from that partial hand. The player may then elect to play one or more of the potential games from at least two distinct games of poker available for play with that hand. The nature of the at least two distinct games is that at least two of the games which may be played from the partial hand require decisions to be made where a decision with regard to a election of play strategy in one poker game that is intended to have or assist in getting a positive outcome is likely to have a negative effect or comprises an adverse strategy in the play of the second game. Various pay tables are provided that differ from each other, with respect to each single game, depending upon whether the player elects to play a single game with the partial poker hand or elects to play at least two games with continued play of the partial poker hand.

U.S. Pat. No. 6,312,334 (Yoseloff) describes a method of playing a casino video wagering game that includes at least a first and second segment. The method comprises the steps of: placing a wager to participate in a video wagering game; playing the first segment of the video wagering game; continuing play of the first segment until at least one predetermined condition has been met; assigning a payout based on at least one predetermined winning outcome of the first segment; playing the second segment of the video wagering game when the at least one predetermined condition has been met; wherein at least a portion of said payout of the first segment is used as a wager in a second segment video wagering game in which a visually different screen format is used in play of a different game in the play of the second segment; and after play of the second segment video wagering game, a second segment payout is assigned based on at least a predetermined outcome of play of the second segment video wagering game.

Published U.S. Patent Application 2003/0134673 (SLOT MACHINE WITH ESCALATING SYMBOL VALUES, Moody) describes a slot machine game. If the player achieves a winning combination of symbols on active pay lines, the player is provided with a second spin of the slot reels, but the first set of slot symbols are replaced with a second set of slot symbols that have higher potential payouts. If the player achieves a winning combination of symbols on active pay lines on the second spin, a third spin is offered with a third set of symbols with even higher potential payouts. As long as the player keeps winning on each successive spin, the symbols continue to be replaced with higher value symbols. Once the player loses, the symbols reset to the first symbol set. Each successive spin may be a free spin, or may require an additional wager for the successive spins, or the some of the successive spins may be free and others may be require an additional wager.

Published U.S. Patent Application 2004/0002376 (GAMING DEVICE HAVING INCREMENTING AWARD BONUS SCHEME, Swift) describes a gaming device and method having a bonus game, where the gaming device enables a player to select symbol indicators such as a pair of dice from one or more pairs of dice. The gaming device rolls the selected pair of dice and the player receives a random number that is based on the sum of the numbers on each die in the selected pair of dice. If the number is not a terminator or doubles, an award is provided to the player. Subsequently, an award accelerator increases the award for the next roll by a random or predefined amount. If the number is a terminator, the game ends and the player receives the total accumulated award in the game. If the number is doubles, the player receives a larger award generated by the award accelerator. The accelerator doubles the award for a roll that results in doubles and increases subsequent awards from this award value. The player continues to select pairs of dice until the player receives a terminator or until they have no rolls remaining in the game.

Published U.S. Patent Application 2003/0027626 (ENHANCED PAYOUTS BASED ON CONSECUTIVE WINNING COMBINATIONS, Marks) describes a slot machine that provides enhanced awards for consecutive spins with winning symbol combinations of any type ("Consecutive Wins"). Enhanced may be defined as any award in addition to the award indicated by the game's base level award schedule. Enhanced awards may include: any type of award (e.g., credits or free spins); any amount of award (e.g., ten times the base level award or five free spins); any combination of awards (e.g., credits and a free spin); and any schedule of enhancement (e.g., five times the base level credits for the first three consecutive wins and ten times the base level credits for any additional consecutive wins). Following any loss, the game returns to the base level award schedule.

Published U.S. Patent Application 2004/0017043 (Moody) describes a video poker game. The player makes a wager on a first round of video poker. If the player achieves a winning hand combination on the first round of video poker, the player is offered the opportunity to play one or more hands of video poker against a higher pay table on the next round of video poker. The player may continue to play against the higher pay table as long as the player continues to achieve winning combinations during each round of play. If the player fails to achieve a winning combination during a round of play, the game resets to the initial lower pay table and the player starts over.

SUMMARY OF THE INVENTION

A player places a wager to participate in the play of the game, which may include a single hand of play (at the player's option) or may comprise sequential hands in the play of the game (again, usually at the player's option, although there may be required ongoing hands. If the player obtains a hand of at least a minimum rank in a first game, the player has the option (or in special circumstances is required) to play a second hand in which potentially available winning amounts may be increased if the rank of the second hand ties or exceeds the rank of the hand in the first game (or round). The sequence of games may continue into additional rounds, with the player required to obtain a hand of equal or increased rank (over the preceding hand) to obtain potentially increased awards. The player may risk none, some or all winning or wagered amounts in the continuing sequence of rounds. A first round may be played with a single or multiple hands, and subsequent rounds may be played with single or multiple hands compared against a single hand from the first round.

DETAILED DESCRIPTION OF THE INVENTION

Figure 1:
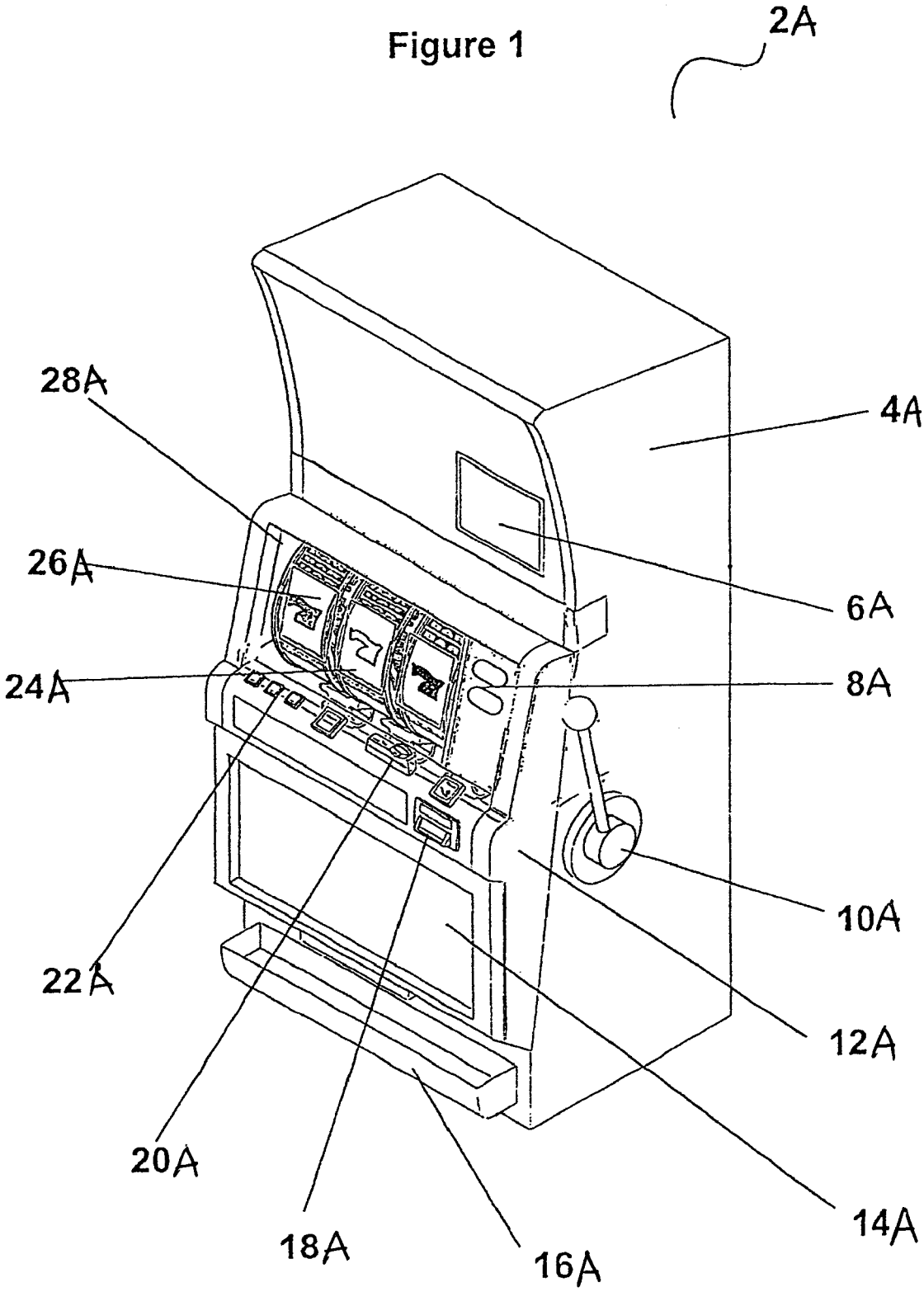
FIG. 1 shows a general video gaming machine useful in the practice of the present invention.

An electronic video gaming system or casino table card game is provided where multiple hands of poker are played simultaneously, consecutively or in a staggered fashion. By "poker" is meant one or more of the many variations of poker as it is known in the gaming art, including but not limited to 3, 4, 5, 6, or 7 card games, stud poker games (cards are dealt to complete a hand without the possibility of replacement), draw poker games (where cards are dealt in an initial hand, and then none, one or more than one, up to the total number of cards in the hand, may be replaced), wild card poker games of both the stud and draw varieties (where a special wild card or joker, or a specified rank, suit or rank and suit set of cards is 'wild,' being useful as any card designated by the player or house), Pai Gow Poker, and other variations of card games that are referred to in the art as poker games. Cards as used in the practice of the present invention include images of cards as well as physical cards.

A basic and general description of the practice of the invention is as a method of playing a wagering game with at least two consecutive plays comprising:

placing at least a first one bet;

receiving at least one first set of symbols from which a rank may be determined in reading the symbols;

determining the rank of the first set of symbols;

comparing the rank of the first set of symbols to an advancing rank table (that may include payout levels for certain hands in a payout table);

determining whether the rank of said first set of symbols meets or exceeds a minimum rank in the advancing rank table and/or the payout table;

if the rank of the first set of symbols meets or exceeds at least a minimum advancing rank, receiving at least a second set of symbols from which a rank may be determined in the second set of symbols;

determining the rank of the second set of symbols; and comparing the rank of the second set of symbols to the rank of the first set of symbols (and possibly also a second payout table and/or a second minimum rank table);

determining whether the rank of said second set of symbols exceeds (or at least equals) the rank of the first hand (and possibly at least a minimum rank in a payout table);

resolving the at least one bet with respect to whether a) the second set of symbols equal or exceeds the advancing rank of the first set of symbols and/or b) the first set of symbols and/or the second set of symbols exceeds a minimum rank in the payout table. The same game (in different rounds) may continue after each event where a ranked hand in a last game (or round) equals or exceeds the last rank achieved in the nearest earlier game (or round).

The wagering structure may be varied in numerous ways. For example, a single wager may be placed before the first hand (first round) is dealt, and a) that wager may have to be carried into each successive round, or b) a portion of the wager may have to be carried into any successive round required to be played or elected to be played, or c) any winnings or at least a part thereof (and/or the initial wager or a part thereof) obtained from a paytable or previous sequences of rounds where there has been a payout to the player may have to be wagered or may be elected to be wagered in sequential rounds where the player elects or is required to continue play in the sequence of hands.

In appreciating the play of the game, certain terms should be understood to assist in an understanding of the invention.

A "hand" is a set of symbols (usually in a card game) shall be a set of symbols or especially cards that may be evaluated for rank (especially such as for high cards, pairs, multiple pairs, three-of-a-kind, straights, flushes, full houses, four-of-a-kind, straight flushes and Royal Flushes) that is played by one or more players or a dealer. This is standard poker terminology. The hand may be dealt all at once, in segments, or an initial hand (or partial hand) dealt and cards replaced (usually referred to as a draw) or added (either as cards unique to that player's hand or as community cards in a "flop").

A "game" is a complete play of hands to a player according to the rules of a game.

A "round" is a segment of a game wherein there is at least a partial conclusion of playing events, with or without resolution of awards. For example, in standard five card draw poker on a video game, a round is finished when the player has placed a wager, received the initial cards (usually five cards), elected which cards to keep or discard, received any replacement cards for discards, and the hand has been evaluated against a paytable to determine winning, pushing or losing events. In other games, a round may not be always so determinative. For example, in the well-known club/social poker card game "Jacks-to-One/Trips-to-Win," there may or may not be any winning or losing events in a round. A round may involve all players receiving five initial cards, all players electing their individual holds and draws, all players placing the necessary wagers, and no player achieving at least a rank hand of three-of-a-kind, so that at the conclusion of that round, another round of the same game will be played. A usual indication of the end of a round is where players may not further alter their cards or place any further wagers on the cards presently in their respective hands.

Examples of the game of Heat Wave™ poker and its variants will be illustrated and explained herein.

In the play of the game, a first round of poker (e.g., 1-card poker, 2-card poker, 3-card poker, 4-card poker, 5-card poker, 6-card poker, 7-card poker and their variants, as either stud games, wild games, draw games and the like) is played after the player has made a wager. In the first round played with a player's first hand, the rank of the player's hand at the conclusion of the round is determined. A number of events may occur, according to the rules of the game. Among the rules are:

a) With any rank obtained in the first hand, the player must continue into a second round of the Heat Wave™ poker game;

b) With at least a minimum rank obtained in the first hand, the player must continue into a second round of the Heat Wave™ poker game;

c) With at least a minimum hand, the player may continue into a second round of the Heat Wave™ poker game or elect to accept any winnings or push the initial wager.

Among the wagering options, the rules may include:

a) When there is a next round of play, the player must place all of the initial wager at risk;

b) When there is a next round of play, the play must place all of the winnings to date on the game (e.g., from all previous rounds after a first wager) at risk;

c) When there is a next round of play, the play may place a portion of the initial wager and/or winnings to date at risk and withdraw another portion (all or some of the remaining amount);

d) When there is a next round of play, the gaming system or game rules place none, a portion or all of the initial wager; and none, all or some of winnings to date at risk, and credit the player with another portion (all or some of the remaining amount(s)).

The resolution of the bet may be with respect to whether both the first set of symbols and the second set of symbols equal or exceed a specific minimum rank in the payout table and may require that the rank of both the first set of symbols and the second set of symbols both exceed a minimum rank in the payout table for the resolution of the bet on c) to provide a return on the bet. The method may select the basis for the parlay payout in a number of different ways. Where the hands are of equal rank stature (e.g., both straights, both two pair, irrespective of the relative rank within those categories), the basis of the parlay will almost certainly be a payout based on that rank stature (e.g., straight or two pairs, respectively). When the two games have different ranks, yet both are above the minimum qualifying for parlay payouts, a number of different formats may be used. The simplest is to compare the two hands, select the lowest rank of the two hands, and establish a payout table based upon that lowest rank. For example, if the hands comprise a straight and a flush, the hands would be considered as two hands of at least a rank of a straight. The parlay payout would be based upon that collective, minimum value rank. Similarly, if the hands were a full house and a Royal Flush, the payout for the first hand would be for a full house, the payout for the second hand would be for a Royal Flush, and the parlay payout would be for two hands having a rank of at least a full house. Another format would be to have the rank of the first hand determine the parlay payout scale, the rank of the second hand determine the parlay payout scale, an averaging of the two hands determine the parlay payout scale, or have a specific predetermined scale for the parlay payouts.

Another way of describing the play of the invention when cards are specifically used as the symbols would be as a method of playing a wagering game of cards with at least two consecutive hands of card games being played, the method comprising:

placing at least one bet;

receiving at least one first hand of cards from which a rank may be determined;

determining the rank of the first hand of cards;

comparing the rank of the first hand to a payout table;

determining whether the rank of said first hand meets or exceeds a minimum rank in the payout table (and optionally resolving that wagering event or indicating the resolution of that wagering event or waiting until the completion of further play before resolving this wagering event or wagering portion);

receiving at least a second hand of cards from which a rank may be determined;

determining the rank of the second hand of cards;

comparing the rank of the second hand to a payout table;

determining whether the rank of said second hand meets or exceeds a minimum rank in the payout table (and optionally resolving that wagering event or indicating the resolution of that wagering event or waiting until the completion of further play before resolving this wagering event or wagering portion);

resolving the at least one bet with respect to whether a) the first hand of cards exceeds a minimum rank in the payout table; b) the second hand of cards exceeds a minimum rank in the payout table; and c) first hand of cards and the second hand of cards both exceed a minimum rank in the payout table. The method may have all hands dealt from one or more decks of playing cards or a virtual deck or decks of playing cards. The deck of playing cards is most often a standard deck of fifty-two cards, but may comprise specialty decks of cards (e.g., a Spanish 21 TM deck of cards with the 10's missing, a canasta deck, a deck with wild cards, etc. All ranks may be determined as poker ranks. All minimum ranks may be at least one pair. The at least one bet may comprise one, two or three bets. With three bets (three distinct wagering portions or segments, for example), one bet would be allocated towards a), one bet would be allocated towards b), and would be one allocated towards c).

In this embodiment, the game may be a card game with well established hand rankings such as poker, or may be another type of card game in which the player's hand must beat the rank of the dealer's hand. Examples of such games include War, Blackjack and Caribbean Stud™ poker. The rules of the game in this instance include paying the player a payout for beating the dealer in two or more consecutive hands. In one example, the player places a mandatory three part wager and wins the third or "parlay" wager or payout only if the player beats the dealer with both consecutively played hands.

Numerous variations on the play of the game may be made according to the teachings of the present invention. A number of those optional variations are described below.

1) The initial bet may be consistent with regular game wagering. That is, the player may be able to wager 1 to 100 or more units on the play of the game. The paytable for the first round is based upon the total wager and the total wager is not apportioned between rounds. This means that the paytables will get increasingly higher for progressive rounds and it may take winning two, three or four rounds to obtain a push. This is balanced by the fact that winning the first round may be accomplished with a low pair, such as a pair of 2's, 3's or the like, or even an Ace-King high hand. For example, on a wager of $10.00 on the game, a win on the first round might pay 1:10 ($1.00), a win on the second round might be 1:4 ($2.50), the third round 1:2 ($5.00), the fourth round 2:1 ($20.00), the fifth round 10:1 ($100.00), the sixth round 25:1 ($250.00), etc. up to the maximum odds, which might be $1,000,000.00 absolute amount or $10,000:1. The point of interest is that only a single wager needs to be made rather than multiple wagers specifically and equally divisible by the number of wagers. All that needs to be done is for the paytables to be appropriately balanced among the rounds. Extraordinary hands, such as Four-of-a-Kind, Straight Flushes, and Royal Flushes would optionally receive special awards, based on the amount of the original wager, whenever they occur. Payments for these extraordinary hands may also be varied according to the rounds. For example, as the probability of a Royal Flush on five cards being approximately 40,00/1, the typical odds payout of 4,000:1 or 1000:1 may be in place for the first hand, but may decrease for sequential hands, as more hands are being played (increasing the likelihood of a Royal Flush occurring in the game), the payout odds would decrease. Additionally, the payout on the underlying wager would increase as the number of hands in winning sequence occurred.

2) Another variation is for the initial wager to be placed, either on the total game (as in 1), above) or parsed among the segments of the games (such as with eight games elected to be played, placing 8×$5.00 wagers, or $40.00 total), and then providing the player with an option to withdraw all or some of the remaining wager(s). For example, if the player has originally bet on six consecutive wins, and receives four-of-a-kind on the second hand, the player can elect at that point to withdraw from the game and forfeit a portion of the remaining four (6–2) wagers. For example, the rules of the game may require forfeiting ¾ of all remaining wagers, ½ of all remaining wagers, or the fraction or percentage of wagers that must be forfeit can depend on the number of rounds remaining in the original wager. For example, if the original play was for ten rounds, withdrawal after the second round might forfeit 90% of remaining wagers, withdrawal after the third round might forfeit 80%. Depending on the objective of the paytable for incentivizing play, the proportion of forfeiture may increase or decrease as shown in the following table based on a selection of ten initial rounds to be played.

| ROUND | FORFEITURE PERCENTAGE |
|---|---|
| 1 | TOTAL FORFEITURE 100% |
| 2 | TOTAL FORFEITURE |
| 3 | 90% |
| 4 | 80% |
| 5 | 60% |
| 6 | 40% |
| 7 | 30% |
| 8 | 20% |
| 9 | 10% |
| 10 | NOT APPLICABLE |

Alternatively, the following incentivizing schedule could be used.

| ROUND | FORFEITURE PERCENTAGE |
|---|---|
| 1 | TOTAL FORFEITURE 100% |
| 2 | TOTAL FORFEITURE |
| 3 | 10% |
| 4 | 20% |
| 5 | 40% |
| 6 | 50% |
| 7 | 60% |
| 8 | 70% |
| 9 | 90% |
| 10 | NOT APPLICABLE |

The first table would tend to promote continuation of the game at early stages, while the second table would promote later continuation.

3) Another alternative would be for a loss at any point to return the ongoing play of the game to n initial starting point, so that a player does not forfeit all of the initial wager. For example, if a player wagers on 10 consecutive wins, has three consecutive wins (e.g., using the paytables outlined in 1) above) and has won $8.50, the player wins nothing on a losing fourth round, but the fifth round now returns to the equivalent of a first round of play on the initial total wager, or a portion (e.g., one-half) of the initial wager, thus keeping the player active for longer. This base-return type of play upon experiencing a losing result may be a one-time event in a game or a multiple time event (e.g., with losses on the fourth round, the fifth round returns to the base game with six total possible rounds, and with a loss on the eighth round, the game returns to base game play with two possible rounds remaining.

4) Additionally, if a loss occurs on the first round, the game may return to the base game at round 1 and the paytable remain the same or be reduced. The minimum winning hand for the first round may also or alternatively raised for the first round win. For example, a first round continuous win paytable and a first round loss paytable are shown below.

| 1ST ROUND WIN | PAYOUT | 1ST ROUND LOSS | PAYOUT |
|---|---|---|---|
| Hand 1–2's | 1:10 | <2's | 0 |
| >Hand 1 | 1:5 | 10's | 1:10 |
| >Hand 2 | 1:2–3:4 | >Hand 2 | 1:5 |
| >Hand 3 | 2:1 | >Hand 3 | 1:2–3:4 |
| >Hand 4 | 5:1 | >Hand 4 | 2:1 |
| >Hand 5 | 10:1 | >Hand 5 | 5:1 |
| >Hand 6 | 25:1 | >Hand 6 | 10:1 |
| >Hand 7 | 100:1 | >Hand 7 | 25:1 |
| >Hand 8 | 1000:1 | >Hand 8 | 100:1 |
| >Hand 9 | 25,000:1 or absolute amount, such as $1,000,000 | >Hand 9 | 1000:1 |

In another embodiment, the first and second game segments are video, computer, network or electromechanical reel slot games. The player places a three part bet and wins the third bet only if outcomes are obtained in the first and second identical or different reel slot games that award a payout. Reel slot games are ideal for practicing this invention as the games are typically designed with a table of winning outcomes. The outcomes typically have a rank, paying higher amounts for combinations that occur less frequently.

An Exemplary Operating Environment

The following discussion is intended to provide a brief, general description of the suitable computing environment in which the invention may be implemented. While the invention will be described in the general context of an application program that runs on an operating system in conjunction with a personal computer, those skilled in the art will recognize that the invention may also be implemented in combination with other program modules. Generally, program modules include code, applets, routines, programs, components, objects, data structures, etc., that perform particular tasks or implement particular abstract data types. Moreover, those skilled in the art will appreciate that the invention may be practiced with other computer system configurations, including hand-held devices, multiprocessor systems, microprocessor-based or programmable consumer electronics, LAN (large area networks) networks, WAN (wide area networks) networks, minicomputers, mainframe computers, and the like. The invention may also be practiced in distributed computing environments where tasks are performed by remote processing devices that are linked through a communication network. In a distributed computing environment, program modules may be located in both local and remote memory storage devices.

An exemplary non-limiting system for implementing the present invention includes a conventional personal computer (also referred to as a client computer), including a processor or microprocessor, a system memory, and a system bus that couples the system memory to the processor. The system memory may include read only memory (ROM) and random access memory (RAM). A basic input/output system (BIOS) is usually stored in the ROM. The BIOS essentially contains the basic routines that help to transfer information between elements within the personal computer during certain computer operations, such as during start-up. The personal computer further may include a hard disk drive, a magnetic disk drive (e.g., that reads from and writes to a removable disk), and an optical disk drive (e.g., that reads from a CD-ROM disk or reads from or writes to other optical media). The hard disk drive, magnetic disk drive, and optical disk drive may be connected to the system bus by any mechanism such as a hard disk drive interface, a magnetic disk drive interface, and/or an optical drive interface, respectively. The drives and their associated computer-readable media provide non-volatile storage for the personal computer. Although the description of computer-readable media above includes the hard disk drive, a removable magnetic disk and an optical disk, such as a CD, it should be appreciated by those skilled in the art that other types of media which are readable by a computer, such as magnetic cassettes, flash memory cards, digital video disks and tapes, Bernoulli cartridges, and the like, may also be used in the exemplary operating environment.

A number of program modules may be stored in the drives and RAM, such as an operating system and a network browsing program module. In general, the network browsing program module is a tool used to interact with other computers over data networks, such as the Internet and the World Wide Web. The network browsing program module is also a tool capable of using downloadable program modules, such as the puzzle control module, in order to direct operation of the personal computer. The drives and RAM may also store other program modules, and program data (such as image data, player input data, random number generators, comparator data [for comparing hands and comparing results with lookup tables], and other game play data).

The operating system, in conjunction with the BIOS and associated device drivers, may provide the basic interface between the computer's hardware and software resources, the user, and program modules such as the network browsing software module. A user may enter commands and information into the personal computer through a touchpad, button panel, touch screen surface, light wand surface, joy stick, and/or keyboard and an input or pointing device, such as a mouse. Other input devices (not shown) may include a microphone, a joystick, a game pad, a tracking ball, a light wand, a light gun, a satellite dish, a scanner, or the like. These and other input devices are often connected to the processor through a serial port interface, such as a game port or a universal serial bus (USB). A monitor or other type of display device (e.g., public view screen, integrated monitors, serial monitors, grid monitors, and the like, with any imaging format, such as CRT, plasma screen, projection viewing, Liquid Crystal display, etc.) is also connected to the system bus via an interface, such as a video adapter. In addition to the monitor, personal computers typically include other peripheral output devices (not shown), such as printers, peripheral light displays, and speakers.

The personal computer may operate in a networked environment using logical connections to one or more remote programmable devices, such as a remote computer. The remote computer may be a server, a router, a peer device, or other common network node. Typically, the remote computer includes many or all of the elements described relative to the personal computer. In one embodiment of the present invention, the remote computer's memory storage device contains data (such as the game control module and the game data) which may be downloaded to the personal computer. The memory storage device also contains program modules (such as the game server module) which may be used by the remote computer when communicating with the personal computer. This type of format may be particularly desirable where there is related play, as among various similar devices, when associated in a bank of video gaming equipment or when there is a coordinated jackpot function, with numerous video gaming systems engaged in potential jackpot play, within one bank of computers, within one casino, within multiple casinos, or within many different gaming jurisdictions.

The logical connections depicted may include a local area network (LAN) and a wide area network (WAN). Such networkingenvironmentsarecommonplaceincasinos,offices, enterprise-wide computer networks, intranets and the global Internet. When used in a LAN networking environment, the personal computer is connected to the local network through a network interface. When used in a WAN networking environment, the personal computer typically includes a modem or other means for establishing communications over the wide area network, such as the global Internet. The modem, which may be internal or external, is connected to the system bus via the serial port interface. In a networked environment, program modules relative to the personal computer, or portions thereof, may be stored in the remote memory storage device. It will be appreciated that the network connections show are exemplary and other means of establishing a communications link between the personal computer and the remote computer may be used.

As discussed earlier, one embodiment of the present invention is embodied in the game control module within the video gaming apparatus as software, hardware or a combination of software and hardware. The game control module essentially controls the previously discussed computerized game. In one operating environment, the game control module is used in conjunction with a network browsing program module, which is supported by an available operating system. Such as Microsoft Corporation's "WINDOWS 95" or "WINDOWS NT" operating systems, LINUX, UNIX, or the like. However, it should be understood that the invention can be implemented for use with other network browsing program modules and with other operating systems and hardware, such as Microsoft Corporation's "WINDOWS 3.1" operating system, IBM Corporation's "OS/2" and "AIX" operating systems, SunSoft's "SOLARIS" operating system used in workstations manufactured by Sun Microsystem, Hewlett-Packard's "HP-UX" and "RT-UX" operating systems, and the operating system used in "MACINTOSH" computers manufactured by Apple Computer, Inc.

From this brief description, it should be appreciated that operating systems, such as the "WINDOWS 95" and "WINDOWS NT" operating system, are quite complex and provide a wide variety of services that allow users and programs to utilize the resources available in the personal computer. Those skilled in the art will be familiar with operating systems and their various features. For more comprehensive information regarding the "WINDOWS 95" and "WINDOWS NT" operating system and its interaction with programs, the reader may refer to any of a variety of publications, including the "Win32 Programmer's Reference" and "Advanced Windows", both published by Microsoft Press.

Play of the Game

A player at a video gaming apparatus places a wager in the apparatus or system (by coins, currency, crediting, debiting or the like). In this example, three identical wagers of $0.25 (twenty-five cents) are placed into the play of a single game. A rough view of a video gaming apparatus 2 on which the game of the present invention may be readily played is shown. The apparatus 2 comprises a display panel 4 (e.g., a CRT monitor) having operator control buttons thereon. These buttons may represent any of the operationally player controlled functions such as a cash out button 8, bet one credit button 10, player hold/discard buttons 12, 14, 16, 18 and 20, currency or coin slot/acceptor 22, deal/draw button 24, and maximum bet button 26. A first player's hand is shown along line A–A' and a second player's hand is shown along line B–B'. The game is begun, for example, by the player pressing maximum wager button 26 or pressing the wager one credit button 10 the desired amount of times. The deal/draw button 24 is then pressed, or with the maximum bet button 26 being pressed, the deal is automatically started. Upon pressing the maximum bet button 26, the maximum wager for three bet units 28, 30, and 32 is displayed. For any incremental bets, the amount of the incremental bet for the three bet units 28, 30, and 32 is displayed.

A typical series of pay table is shown below:

| OUTCOME PAY TABLE I |
|---|
| Royal Flush 800 to 1 |
| Straight Flush 50 to 1 |
| Four-of-a-Kind 25 to 1 |
| Full House 8 to 1 |
| Flush 6 to 1 |
| Straight 4 to 1 |
| Three-of-a-Kind 3 to 1 |
| Two Pair 2 to 1 |
| Pair of Sixes or Better 1 to 1 |

| PAYOUT TABLE II | |
|---|---|
| Royal Flush | 500-to-1 |
| Straight Flush | 100-to-1 |
| Four of a kind | 40-to-1 |
| Flush | 7-to-1 |
| Straight | 5-to-1 |
| Three of a kind | 3-to-1 |
| Two pair | 2-to-1 |
| Jacks or better | 1-to-1 |

The amount paid on the play of the first hand may then be indicated in resolution frame or paid frame 44. After play and/or resolution of the first hand, the second hand B–B', on which the second bet 30 has already been placed, may now be displayed by exposing or displaying cards 60, 62, 64, 66 and 68 that constitute the second hand B–B'. The second hand is then resolved according to a pay table. The pay table for play of the second hand may be the same as that for the play of the first hand (this is convenient when the games are the same) or the pay table for the play and resolution of the second hand may be different. After resolution of the second hand, the artificial intelligence of the apparatus determines if the second hand has established at least a minimum predetermined rank that exceeds the rank of the first hand to qualify for the parlay payout 48 to be paid on the game bet 32 as carried into the second round of the game. If both hands are appropriately ranked (the second hand a higher rank than the rank of an advancing rank for the first hand), the apparatus resolves the parlay bet 32 and indicates the amount of the payout in window 48.

The payout amount may be structured in many different ways, with many different pay tables, but one attractive procedure may include such variations within the ranges described below. For purposes of discussion, a "win" is achieved by exceeding the rank in the $x^{th}$ hand of the rank of the $x-1^{th}$ hand. It is assumed in all numbers of wins that the first hand had a rank that allowed the game to proceed, although variations in that rank are also designable according to rules and odds that may be imposed on the game, as discussed later.

| No. of Wins | Payout on Initial Wager | Bonus for Final Rank |
|---|---|---|
| 1 | 2:5–1:1 | See Table I |
| 2 | 1:1–4:1 | |
| 3 | 3:1–6:1 | |
| 4 | 5:1–9:1 | |
| 5 | 7:1–16:1 | |
| 6 | 10:1–30:1 | |
| 7 | 20:1–500:1 | |
| 8 | 100:1–4,000:1 | |

The game may also have bonus at various stages for achieving high rank hands, either by paying out awards at any stage or in any round for particularly high ranked hands or for achieving a particular high ranked hand by a particular round, or by successively winning and maintaining a particularly low rank by a certain stage. Among continuing bonus pay tables or specific round paytables could be:

| Continuous Pay Table (Paid for Rank Achieved in Any Round) | |
|---|---|
| Full House | 3:1–10:1 |
| Four-of-a-Kind | 10:1–200:1 |
| Straight Flush | 50:1–500:1 |
| Royal Flush | 100:1–5000:1 |
| **Rank-at Round Pay Table (Paid for Rank Achieved by Particular Round)** | |
| By Round 2 | |
| Full House | 4:1–10:1 |
| Four-of-a-Kind | 30:1–200:1 |
| Straight Flush | 100:1–500:1 |
| Royal Flush | 1000:1–5000:1 |
| By Round 3 | |
| Full House | 4:1–10:1 |
| Four-of-a-Kind | 30:1–150:1 |
| Straight Flush | 100:1–400:1 |
| Royal Flush | 1000:1–4000:1 |
| By Round 4 | |
| Full House | 3:1–8:1 |
| Four-of-a-Kind | 20:1–100:1 |
| Straight Flush | 100:1–400:1 |
| Royal Flush | 500:1–3000:1 |
| By Round 5 | |
| Full House | 3:1–6:1 |
| Four-of-a-Kind | 10:1–100:1 |
| Straight Flush | 100:1–300:1 |
| Royal Flush | 500:1–2000:1 |

The bonus may decrease with advancing stages as there have been more opportunities for the higher ranked hands to occur, so the payouts may be adjusted because of the change in odds. This will not necessarily diminish the enjoyment of the player as the higher ranked hand indicates a win in the underlying game and can strongly influence the exercise of the player to continue into another round, making any options clearer.

The amount of money at risk and being wagered may be adjusted accorded to numerous available wagering schemes. The simplest scheme is to have only the initial wager placed at risk. That is, the player makes a wager of X credits (it will be assumed to be $5.00 for numerical simplicity) and all awards are based upon a multiplication of the award rate against this initial wager. Any amount won in a round is credited to the player's account and the game continues.

Another wagering scheme is to have the initial wager at risk and then have all of the winnings of the player at risk in subsequent rounds. This may be effected against a single pay table or against separate pay tables for the initial wager and for the winnings at risk. For example, the award rates for bonus hands may be higher, the same or lower against the initial wager and the winnings, with variations in the awards differing at different rounds or stages. Examples of this format with all winnings at risk (if elected by the player to continue) are as follows, with the terms Wager Award (WA) meaning the award payout rate against the wager and the Winnings Award (WIA) being the payout rate against the winnings when played in advanced rounds:

| Round | Hand Rank | Wager Award | Winnings Award |
|---|---|---|---|
| 1 | Pair | Advance Only | 0 |
| 2 | 2 Pair | Advance Only | 1:1 |
| 3 | 3-of-a-Kind | 1:1 | 2:1 |
| 4 | Str. Or Flush | 2:1 | 3:1–5:1 |
| 5 | Full House | 3:1–5:1 | 4:1–8:1 |
| 6 | 4-of-a-Kind | 25:1–50:1 | 10:1–50:1 |
| 7 | St. Flush | 100:1–500:1 | 50:1–500:1 |
| 8 | R. Flush | 500:1–1000:1 | 500:1–4000:1 |

The Player or the processor in the video game may elect to wager only a portion of the winnings, retaining some amount of past winnings. The initial wager may get absorbed into the wagering event and also may not be treated as a separate wagering unit after the first wager. Such an event may be according to a format where the Retained Winnings (RW) are assumed to be 60% and the award in a previous round is assumed to be the lowest award amount against the $5.00 wager.

| Round | Hand Rank | WA | WIA | RW ($) |
|---|---|---|---|---|
| 1 | Pair | Advance Only | 0 | 0 |
| 2 | 2 Pair | Advance Only | 1:1 | 3.00 |
| 3 | 3-of-a-Kind | 1:1 | 2:1 | ~11.00 |
| 4 | Str. Or Flush | 2:1 | 3:1–5:1 | ~37.00 |
| 5 | Full House | 3:1–5:1 | 4:1–8:1 | ~118.00 |
| 6 | 4-of-a-Kind | 25:1–50:1 | 10:1–50:1 | ~1580.00 |
| 7 | St. Flush | 100:1–500:1 | 50:1–500:1 | ~7,800.00 |
| 8 | R. Flush | 500:1–1000:1 | 500:1–4000:1 | ~25,000.00 |

This tends to be a complex format of wagering, so it is preferred that the initial wager be absorbed into the wagering scheme, which simplifies the table as follows:

| Round | Hand Rank | WIA | RW ($) |
|---|---|---|---|
| 1 | Pair | 0 | 0 |
| 2 | 2 Pair | 1:1 | 3.00 |
| 3 | 3-of-a-Kind | 2:1 | ~10.00 |
| 4 | Str. Or Flush | 3:1–5:1 | ~30.00 |
| 5 | Full House | 4:1–8:1 | ~100.00 |
| 6 | 4-of-a-Kind | 10:1–50:1 | ~1200.00 |
| 7 | St. Flush | 50:1–500:1 | ~6,000.00 |
| 8 | R. Flush | 500:1–4000:1 | ~20,000.00 |

Awards may also be based on fixed amounts in a ladder. For example, independent of the rank of hand achieved, each win raises the payout rate against the initial wager and all or some of the winnings to date may be credited to the player, without further risk. Alternatively, all or some of the winnings to date in the game may be placed at risk at ladder odds (either literally against the wagered winnings or amortized to the original wager) or at specific odds for the wagered winnings. By amortized odds, for example, if the initial wager were $5.00, the actual ladder payout was $25.00, and the player elects to wager $10.00 in the next round from the winnings, this would effectively be a $2.00 original wager. If the next win were for a $50.00 win on a $5.00 wager, a win with the $10.00 wager (with the player retaining $15.00 from the winnings), the payout at ladder wagers would be 5:1, or $10.00. This is a less attractive wagering scheme in some regards, but it allows the player to retain winnings and still progress up the ladder.

The initial round of the game may also be varied according to game play design and wagering design. It is possible, at the lowest qualifying level, for the first round to establish a base hand for future wins, with no minimum rank required. This would nearly assure a win in the next round when there was a minimum rank hand (e.g., 7, 5, 4, 3, 2 out of suit) as only an identical hand would fail to be higher then that initial hand. It is preferred that the first hand have at least a minimum established rank (e.g., at least Ace-King, at least any pair, at least a ranked pair, e.g., 3's, 4's, 5's, 6's, 7's, 8's, 9's, Jacks, Queens, Kings or Aces). Once the minimum rank has been established, each successive round need only equal or exceed the previous hand and no further minimum rank needs to be established, although that is an option in play. For example, if the first minimum advancing rank is any rank or a pair of 2's, the next rank may be required to be at least a pair of Jacks. The third rank may be required to be at least two pair, or at least two pair with at least a pair of 10's. Thus, the game may be played with or without minimum rank requirements in each round.

Figure 2:
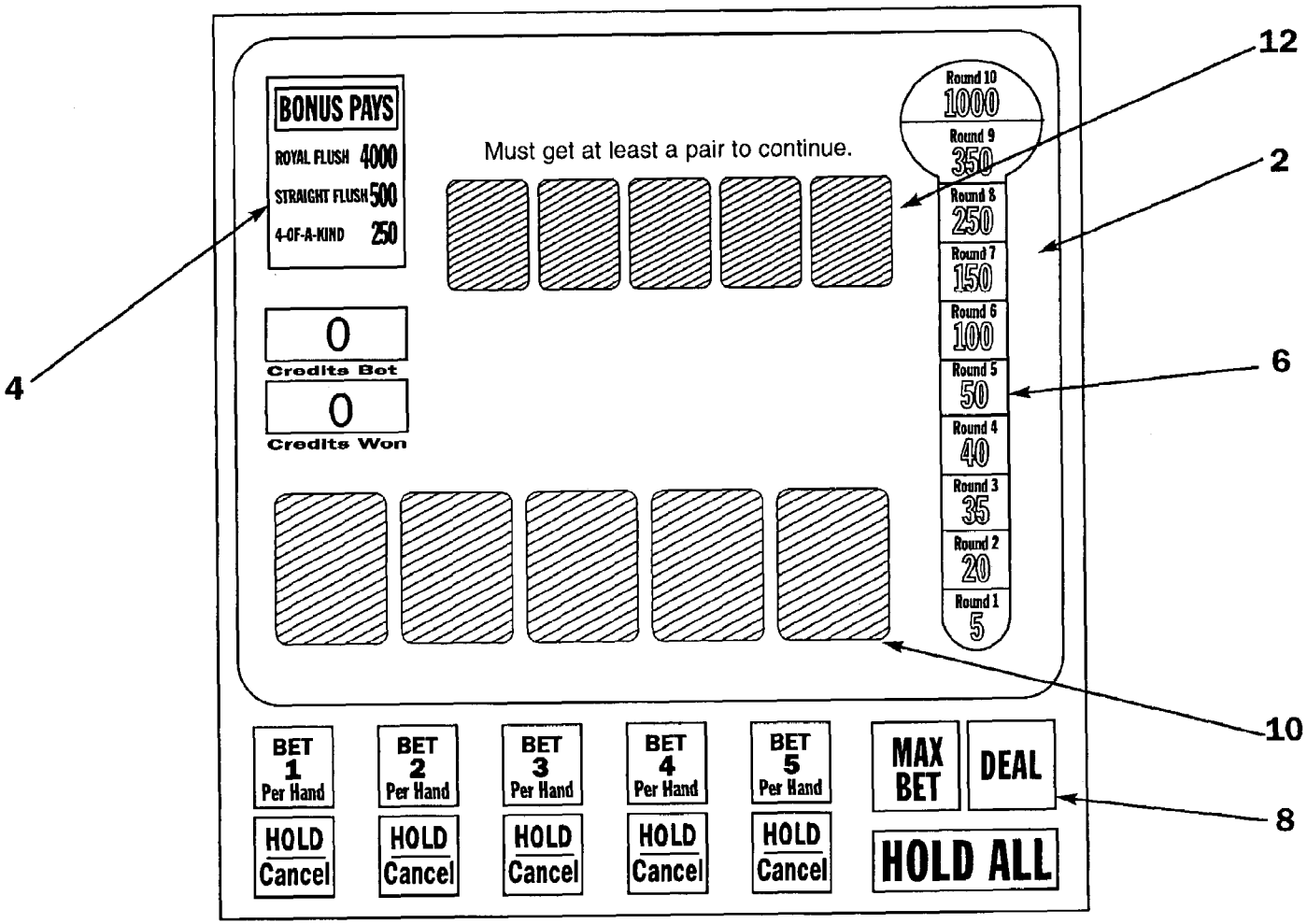
FIGS. 2–22 each show different screen shots of a video poker game (referred to herein as "Heat Wave™ poker game") at different stages of play.
Figure 3:
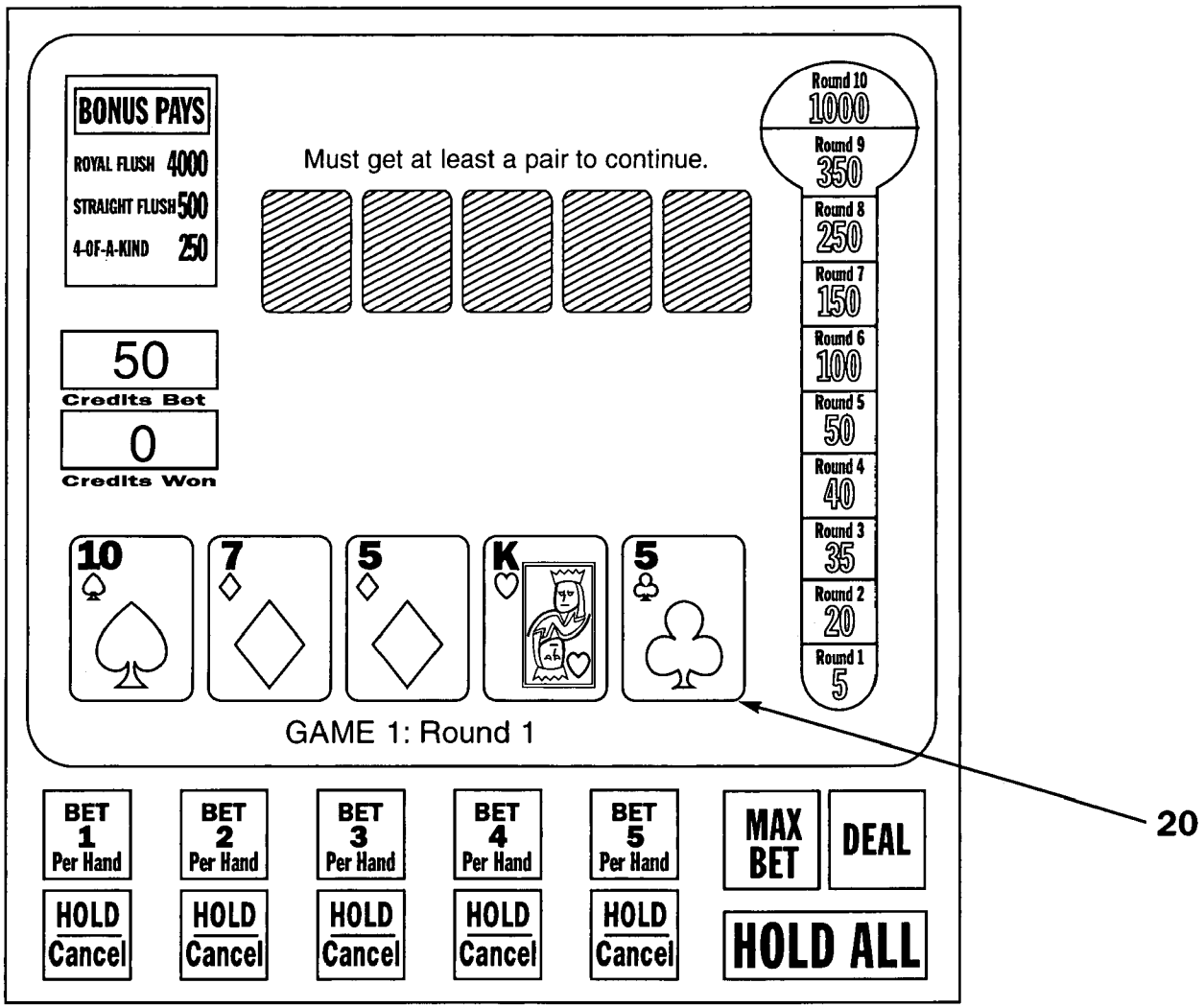
Figure 4:
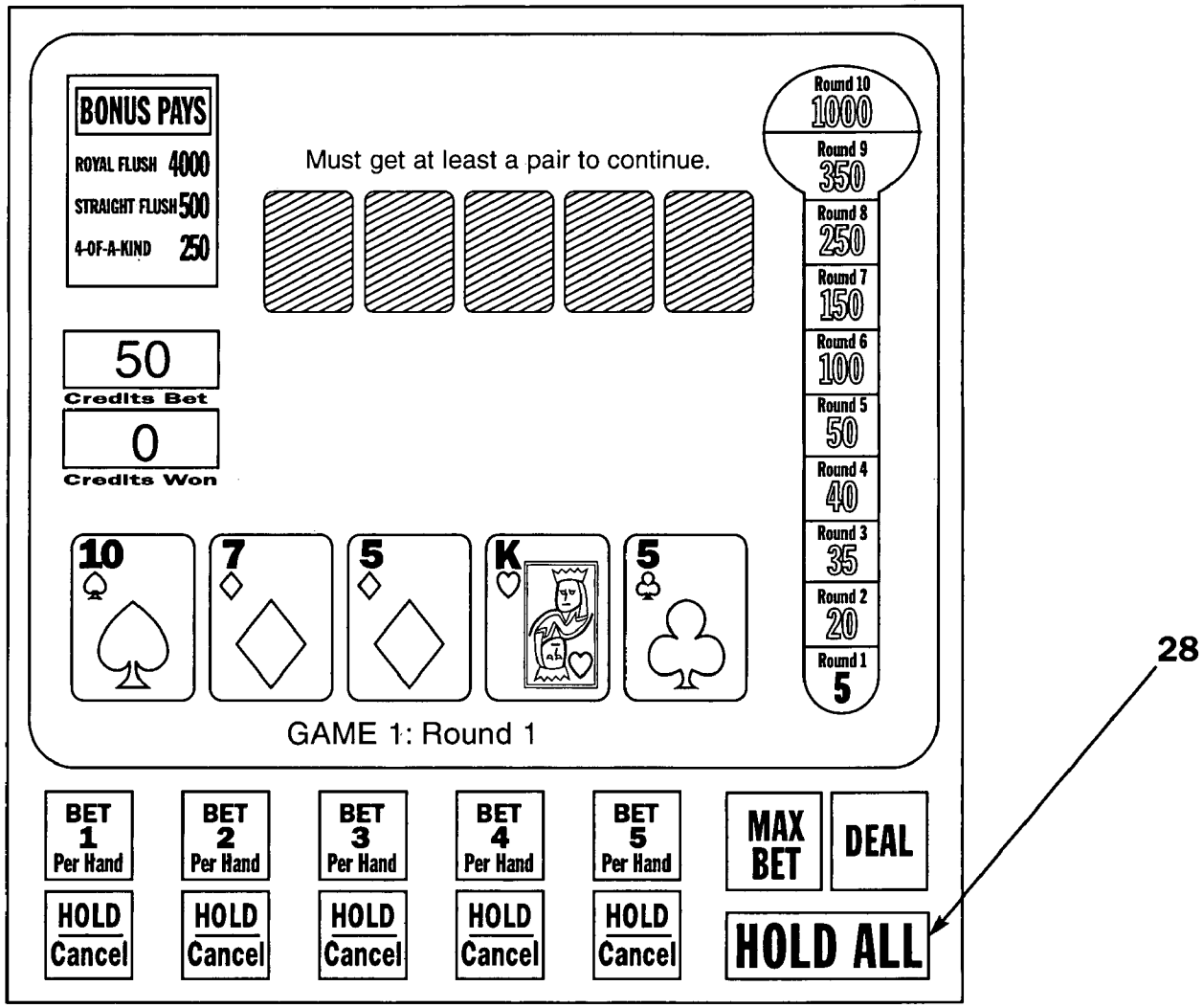

A review of the Figures and an example of a few rounds of play will be instructive. FIG. 2 shows a screen 2 for the game of Heat Wave™ poker while at rest. A pay table 4 for bonus payoffs and the game ladder 6 is shown. Control buttons 8, a first hand display 10 and the last hand played display 12 are also shown. FIG. 3 shows a wager of 50 credits (5 credits for each of 10 hands to be played), and a first hand 20 that has been dealt, with a pair of 5's shown. That is at least a minimum rank needed to advance to the next round of play. In FIG. 4, the player elects to Hold All (button 28) to minimize the rank of the hand. Even though this limits the potential for a bonus award in this round, it maximizes the chance of advancing on the ladder by minimizing hand rank.

Figure 5:
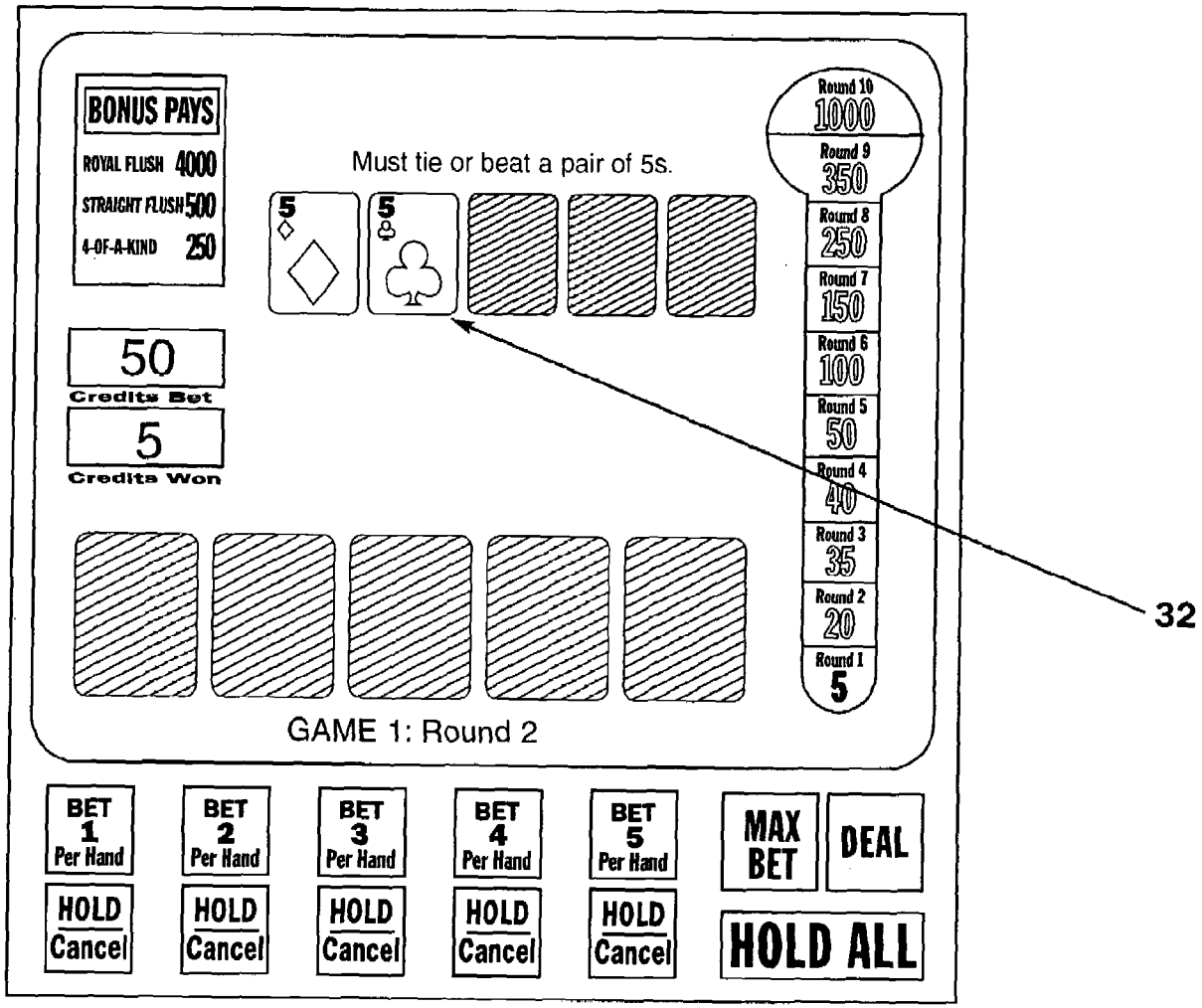
Figure 6:
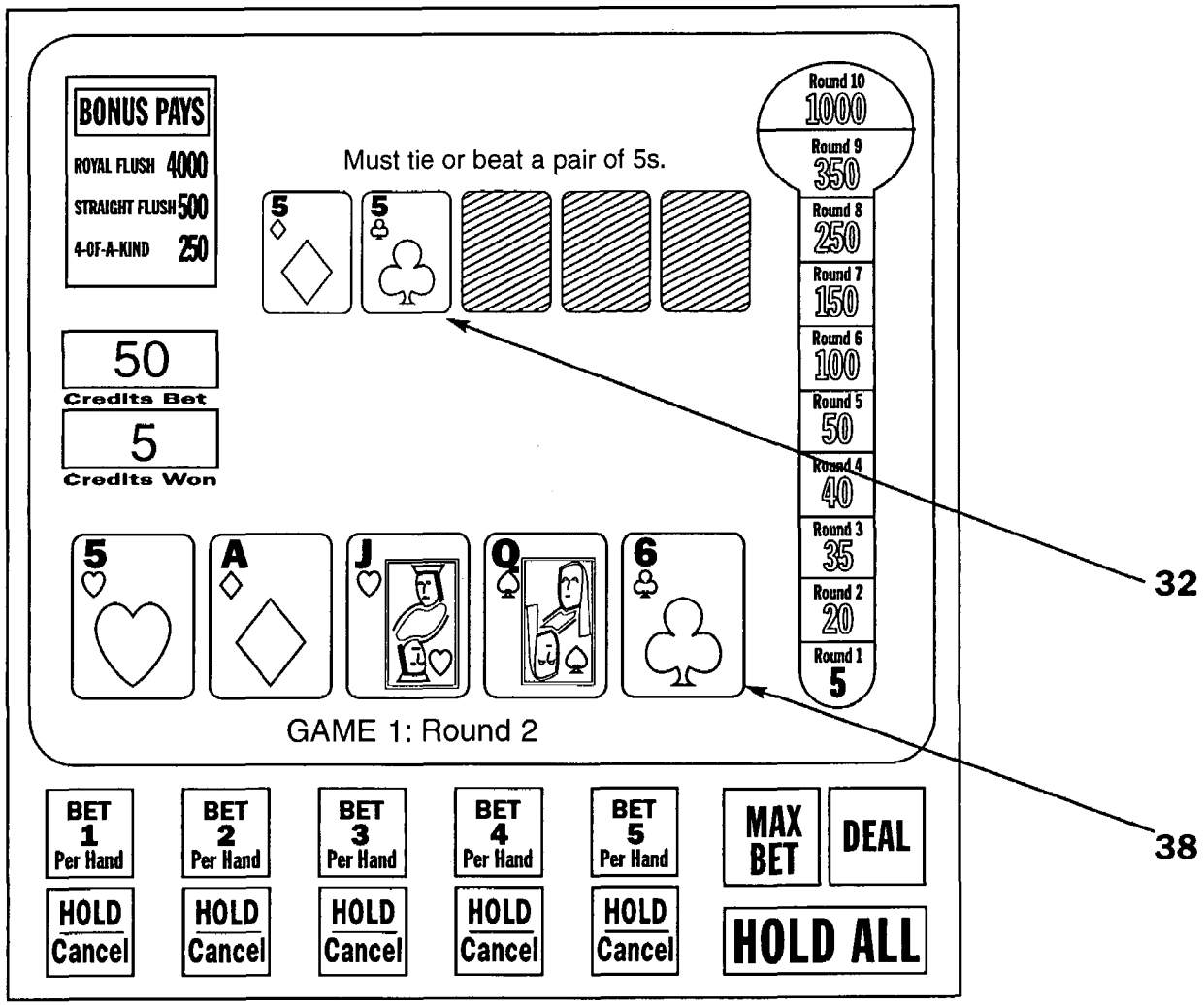
Figure 7:
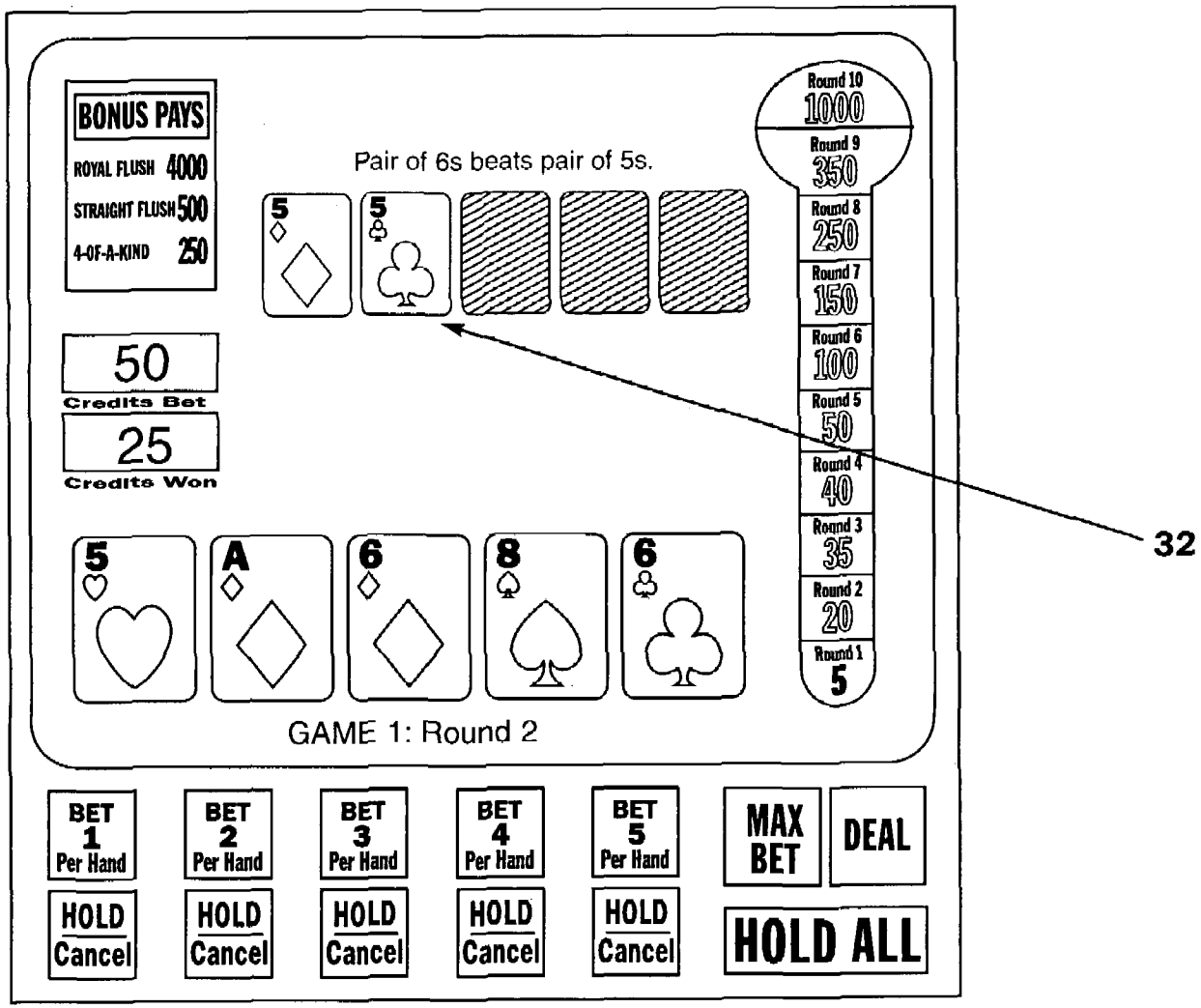
Figure 8:
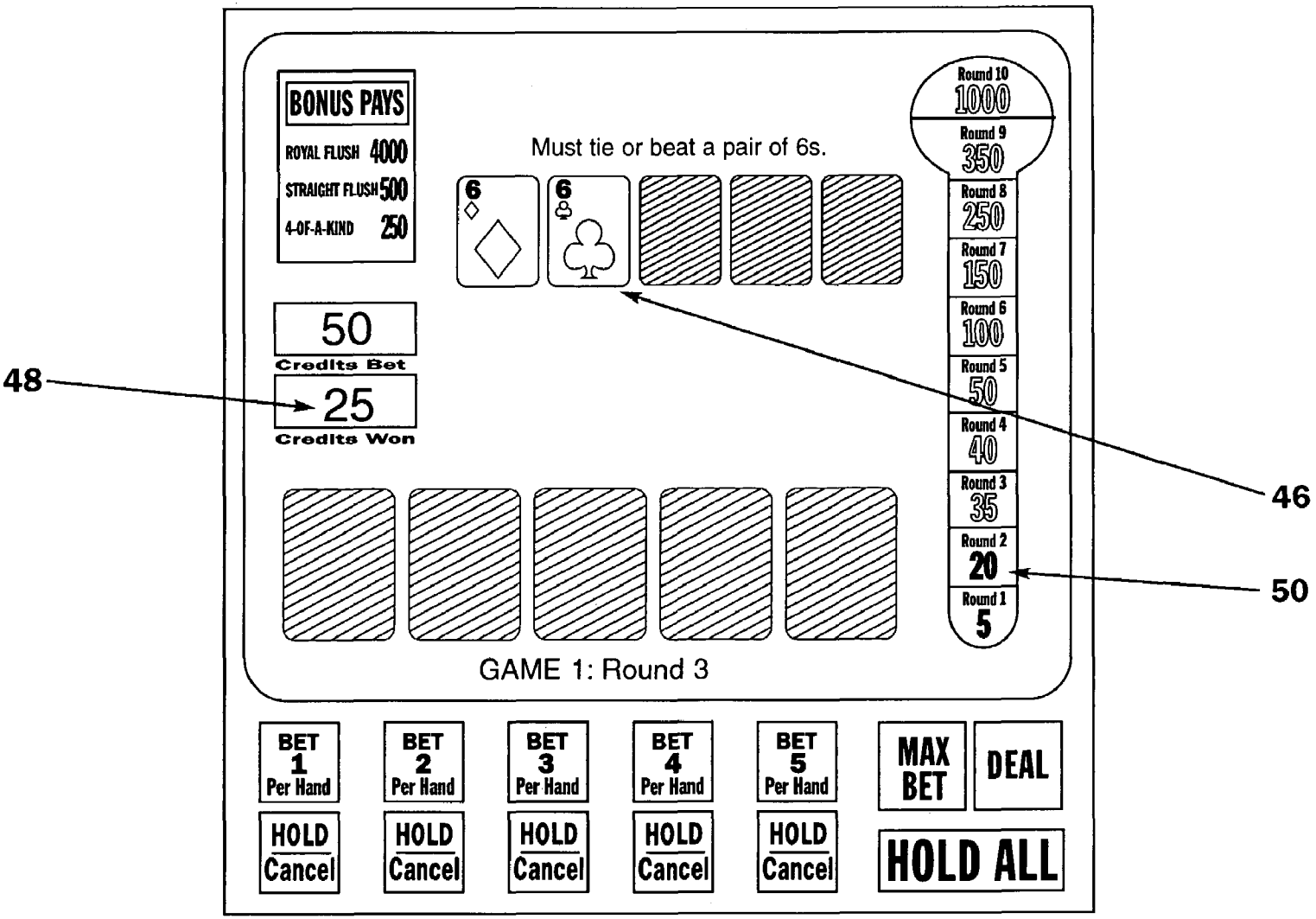
Figure 9:
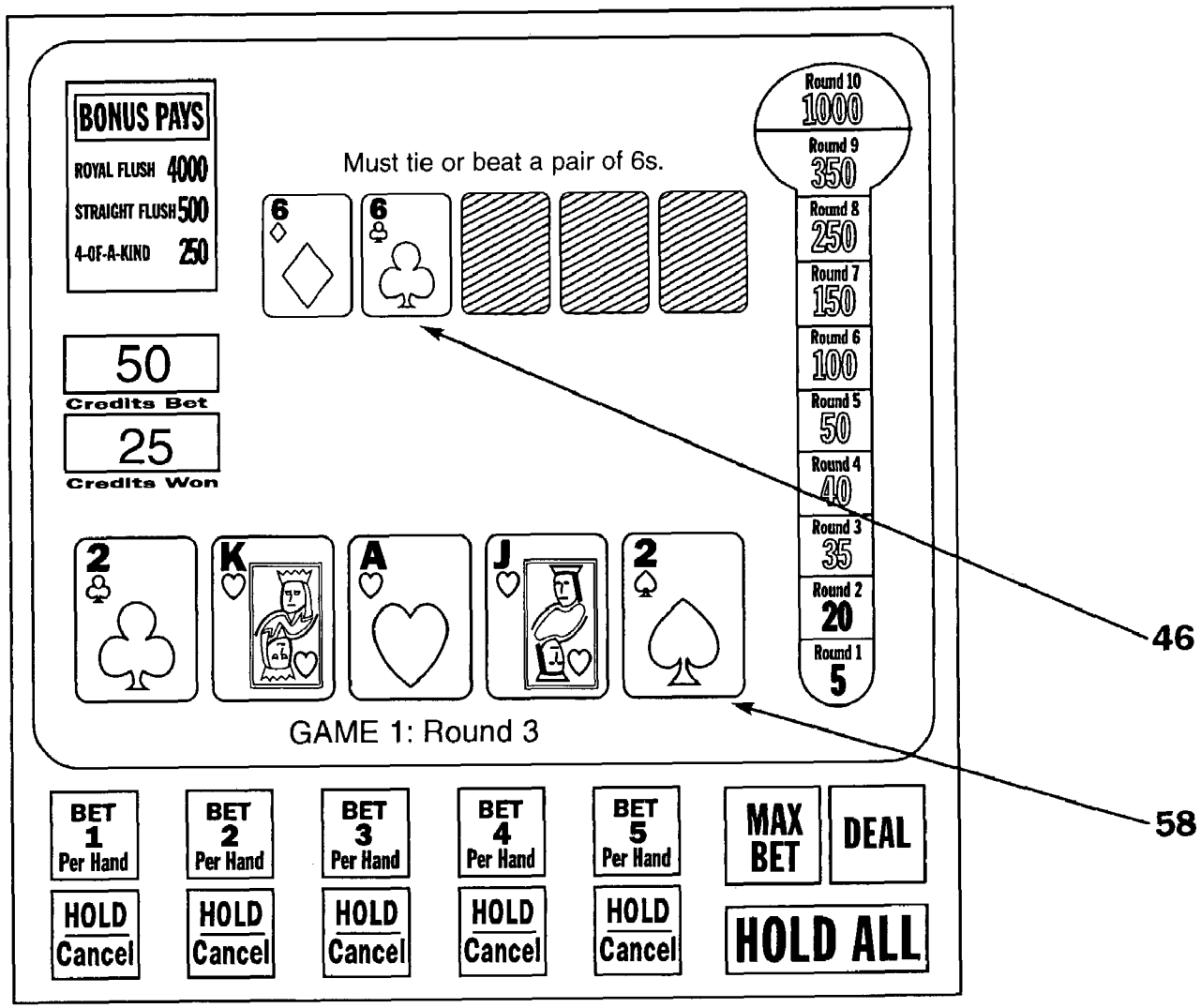
Figure 10:
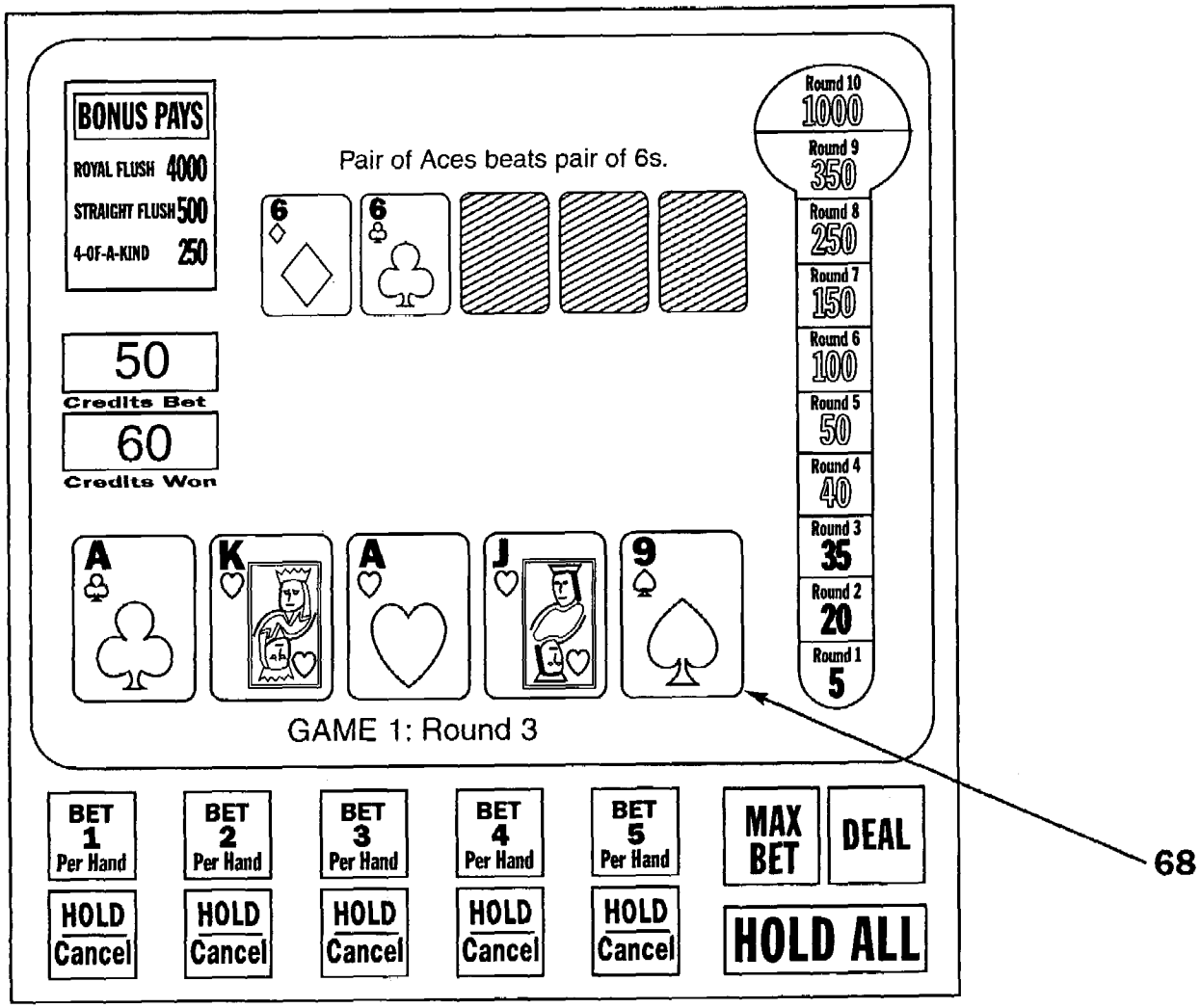
Figure 11:
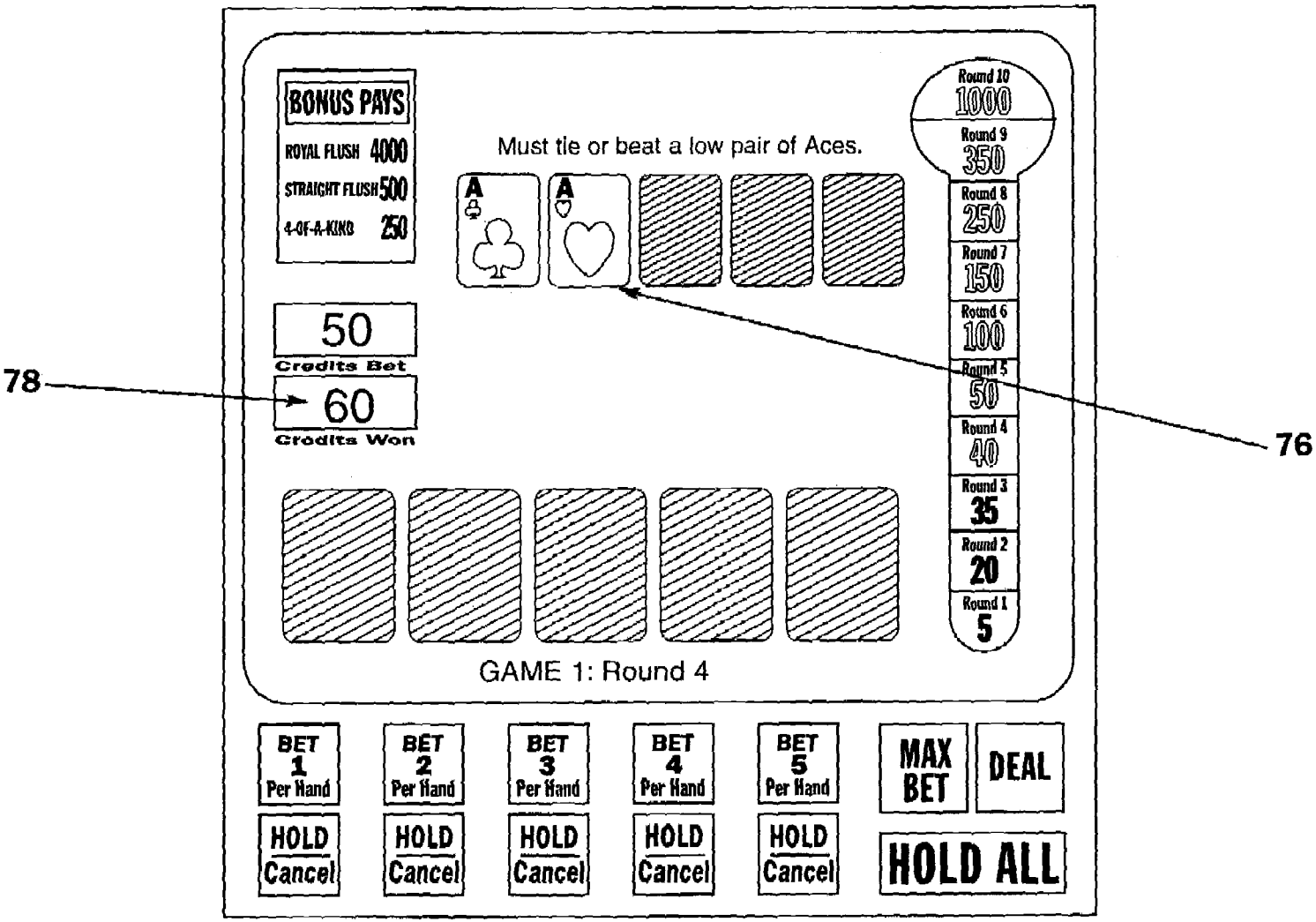

In FIG. 5, the effect of the Hold All action in FIG. 4 is to indicate the Target value hand that must be tied or beaten in the second round as a Pair of 5's (in line 32). In FIG. 6, the second hand 38 has been dealt, which does not automatically exceed the Target Rank 32. The player must therefore decide what cards to hold or discard. In FIG. 7, the player has elected to save the Ace, 6 and 5 so as to hold cards that could be paired to tie or beat the Target Rank 32, yet minimize the rank of the second hand. In this case, a pair of 6's was obtained, which will become the new Target Rank 46 in FIG. 8. The Credits Won 48 are indicated as a win from the first pair (5 credits) and for beating the first pair (the 20 Credits from Game 2 50). FIG. 9 shows the third game play dealt with the third hand 58 on which the player attempts to achieve a hand greater than the Target rank 46 of a pair of 6's, yet minimize the final result by discarding the pair of 2's, saving the Ace, King and Jack. FIG. 10 shows the resulting hand 68 from this strategy as a pair of Aces, winning Round 3 with still only a Pair of Aces. FIG. 11 shows the new Target rank 76 of the Pair of Aces and the total of Credits Won 78 before the next round is initiated. A particular feature may include the Aces being recognized as being a High rank to beat the last hand, then automatically being considered as a Low rank going into the next round. This strategy allows for the ability to, for all intents and purposes, "start over" and hopefully obtain a larger strings of exceeding-rank wins.

Figure 12:
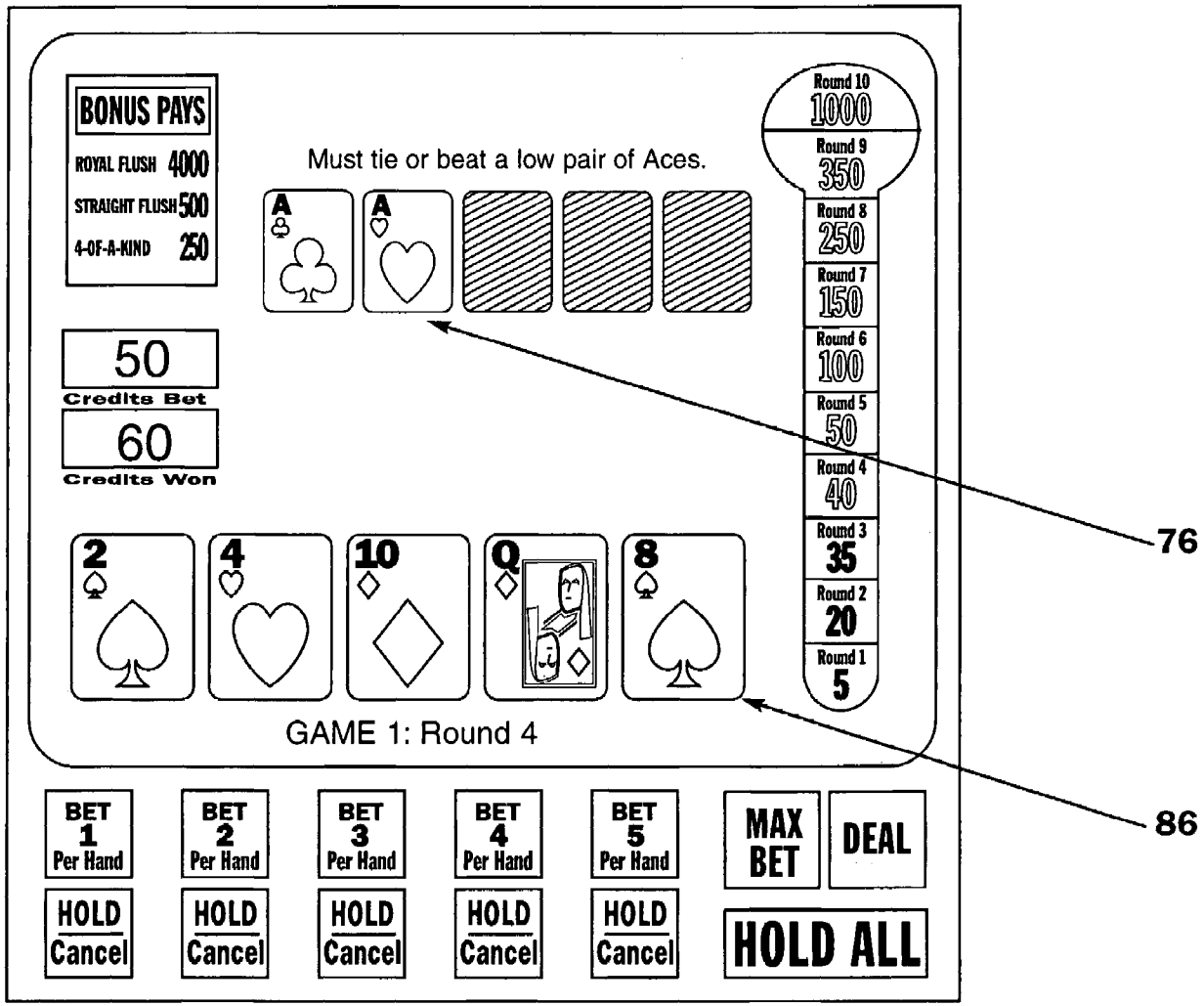
Figure 13:
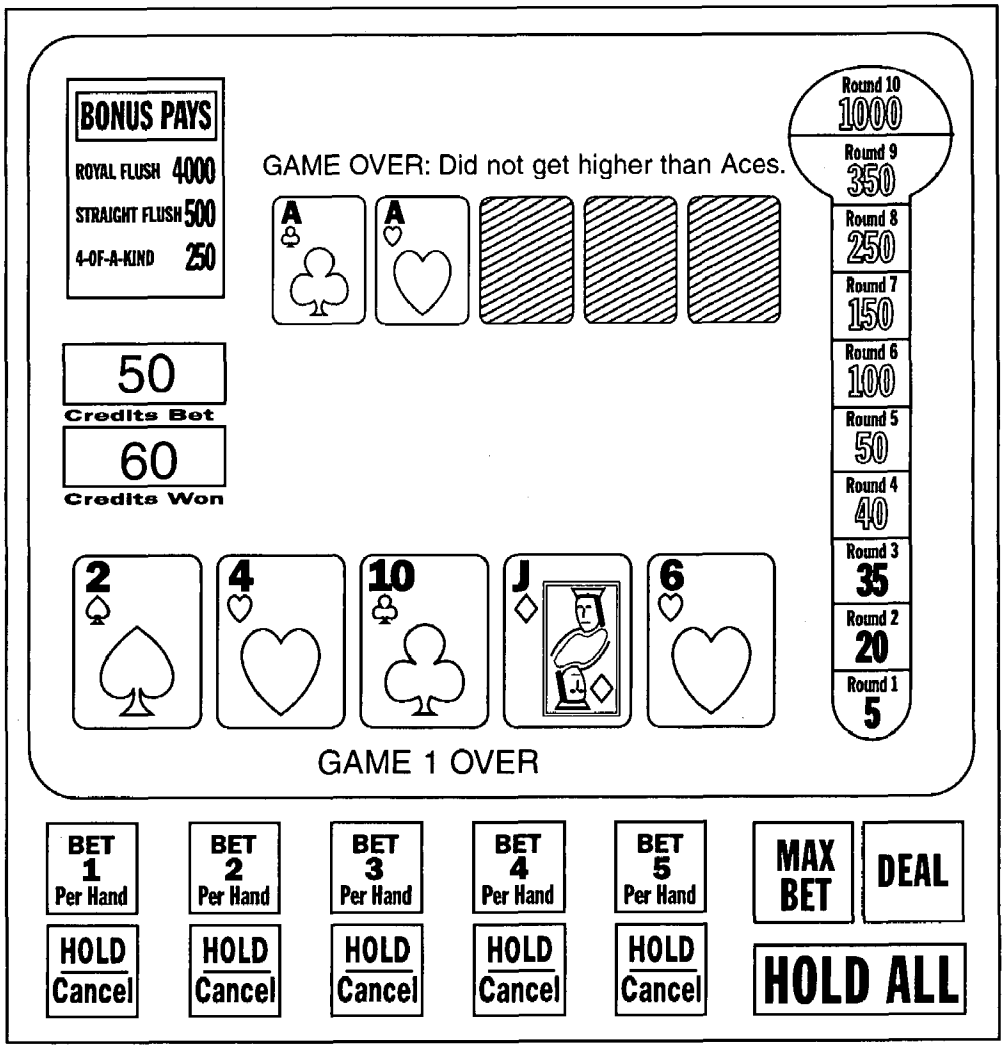

In FIG. 12, the new Target Rank (low aces) 76 is shown along with the initial fourth hand 86. The player elects to hold the 2 and 4, hoping to achieve a Pair of 2s or 4s which would exceed the Low Aces rank of the last round, yet provide another minimal hand for the next round Target Rank. The results of this strategy is the losing hand shown in FIG. 13. The player has won 60 credits on the initial 50 credit wager.

Figure 14:
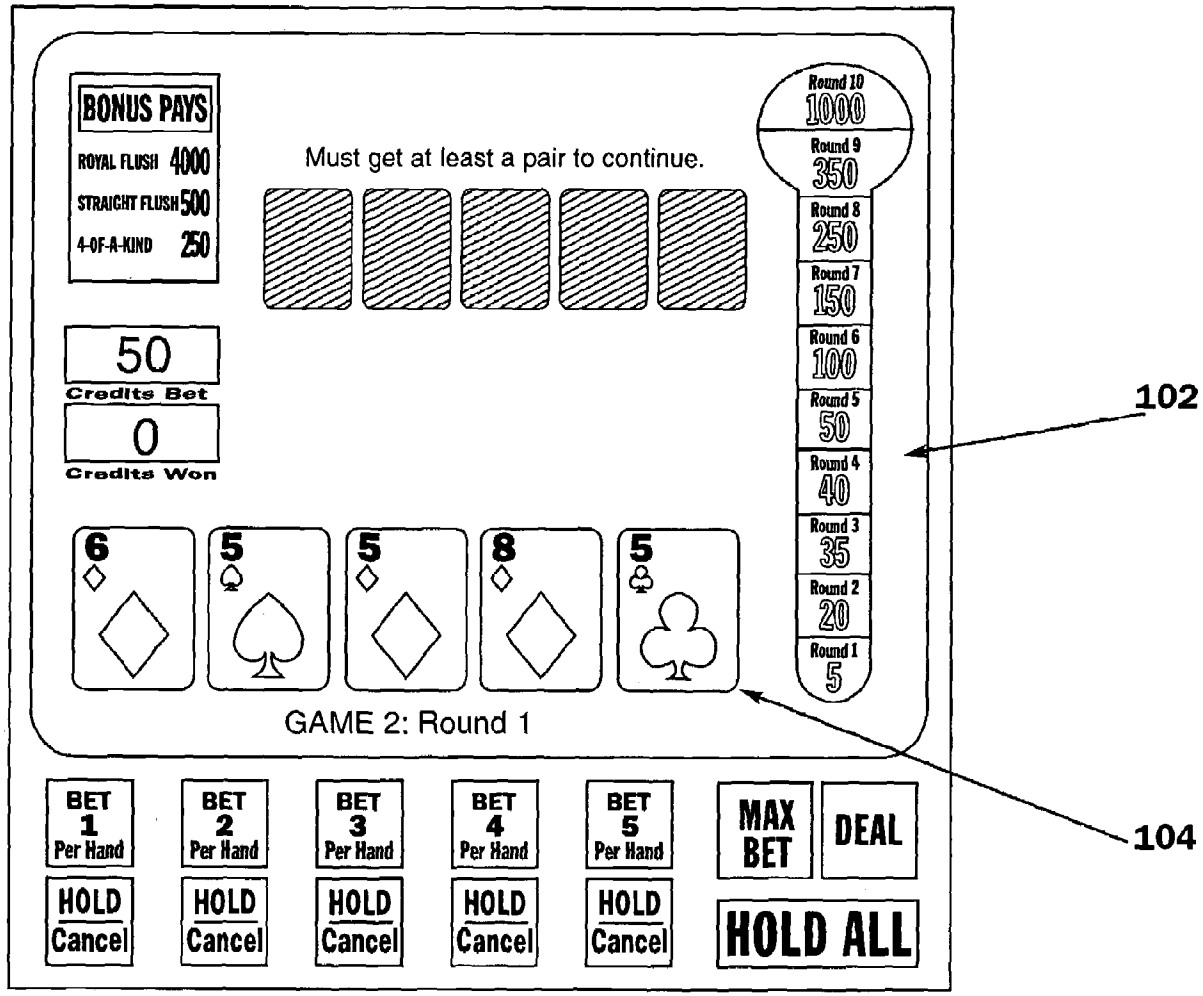
Figure 15:
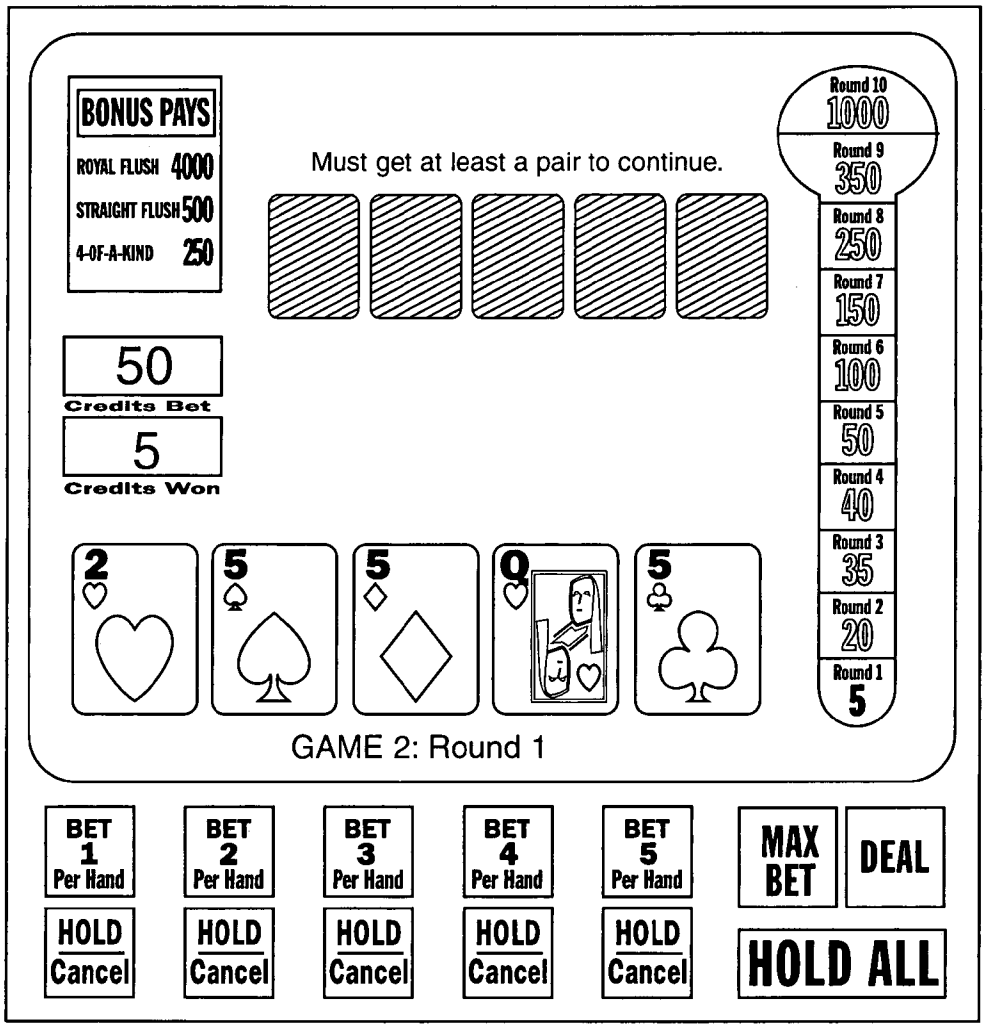
Figure 16:
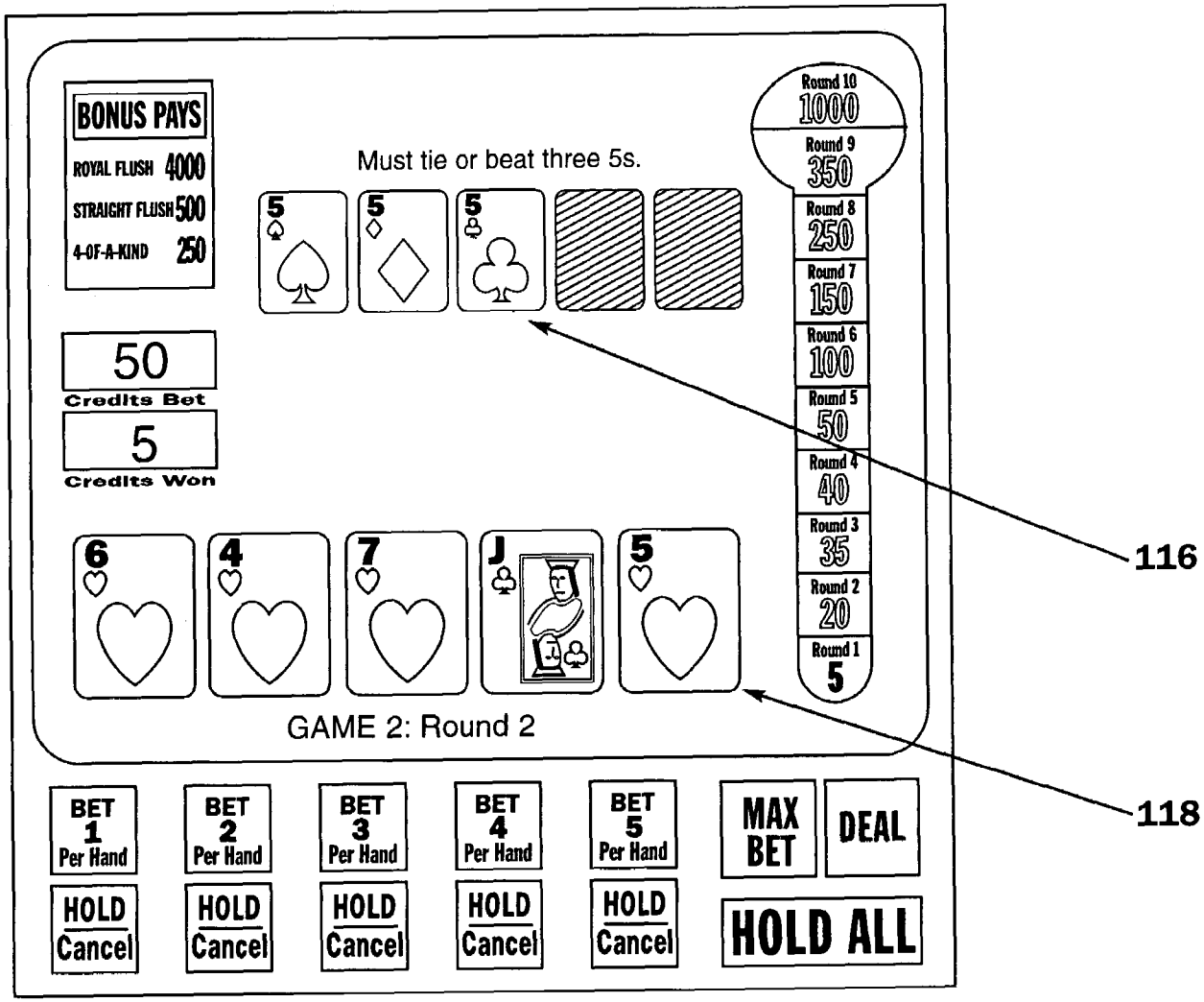
Figure 17:
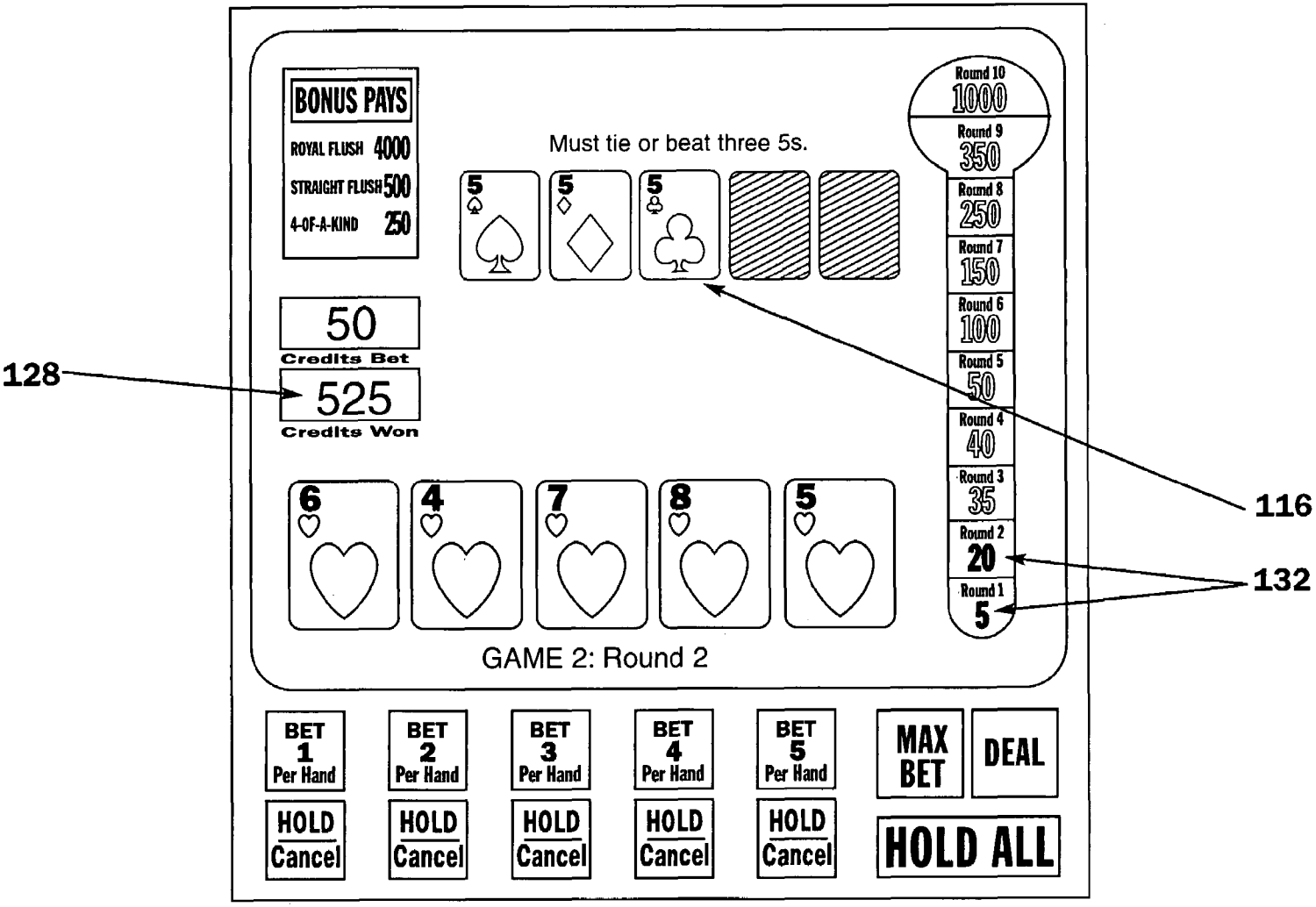

FIG. 14 shows an initial new hand 104 on the video screen 102. This begins a new game. The initial hand 104 is shown as three-of-a-kind (Three 5's) which has a number of options of play. One option is to discard a 5 to keep a low hand in the Ladder aspect of the game, or to keep the Three 5's and hope for a bonus hand. The latter strategy is chosen by way of example. The results of this strategy are shown in FIG. 15, where the hand remains as Three 5's, which becomes the Target Rank 116 in FIG. 16. The initial second hand 118 dealt in FIG. 16 has the potential for a flush, a straight or a straight flush, any of which beat Three 5's and would be a winning hand, so only the Jack would be discarded. The results of this strategy are shown in FIG. 17, with the straight flush obtained. The Credits Won 128 indicate the Bonus Pay of 500 credits and the two game awards from the ladder pay table 132.

Figure 18A:
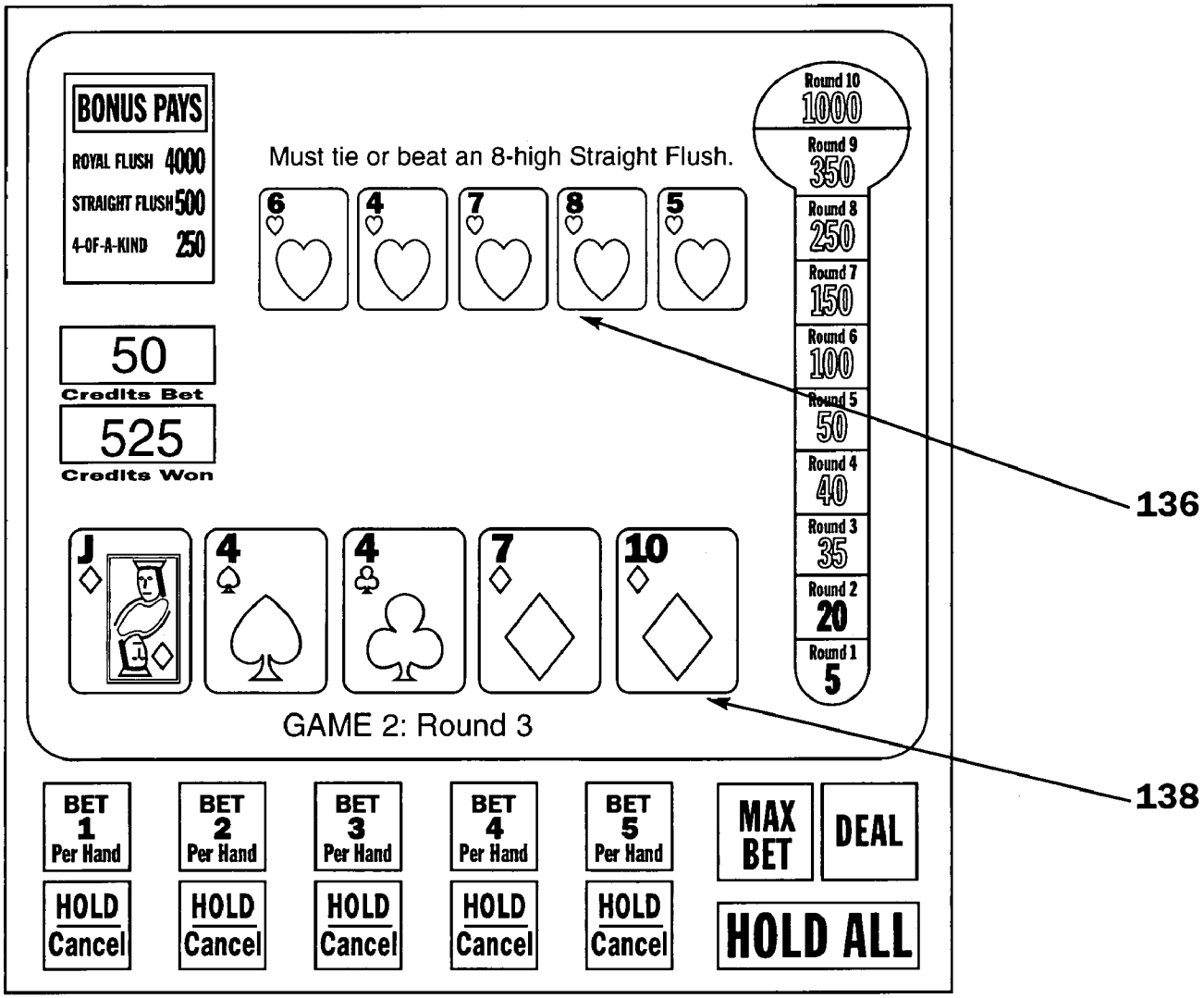
Figure 18B:
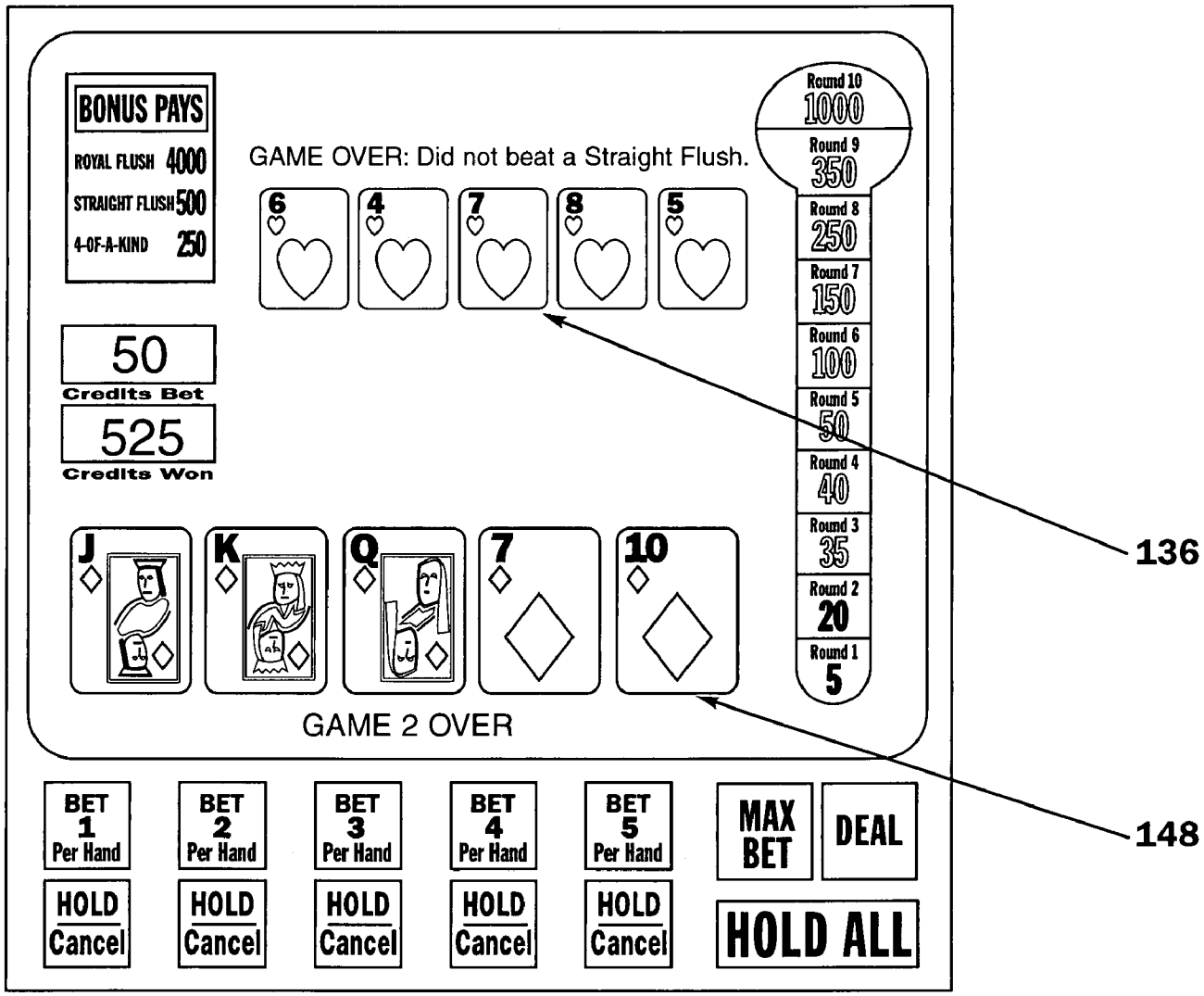

In FIG. 18, the straight flush becomes the new Target Rank 136 and a new hand 138 is shown. The player elects to keep the 7D, 10D and Jack of D, which are the basis for a higher straight flush. The results of this strategy is the flush shown as the fourth hand 148 which does not exceed the Target rank 136 or win a bonus award.

Figure 19:
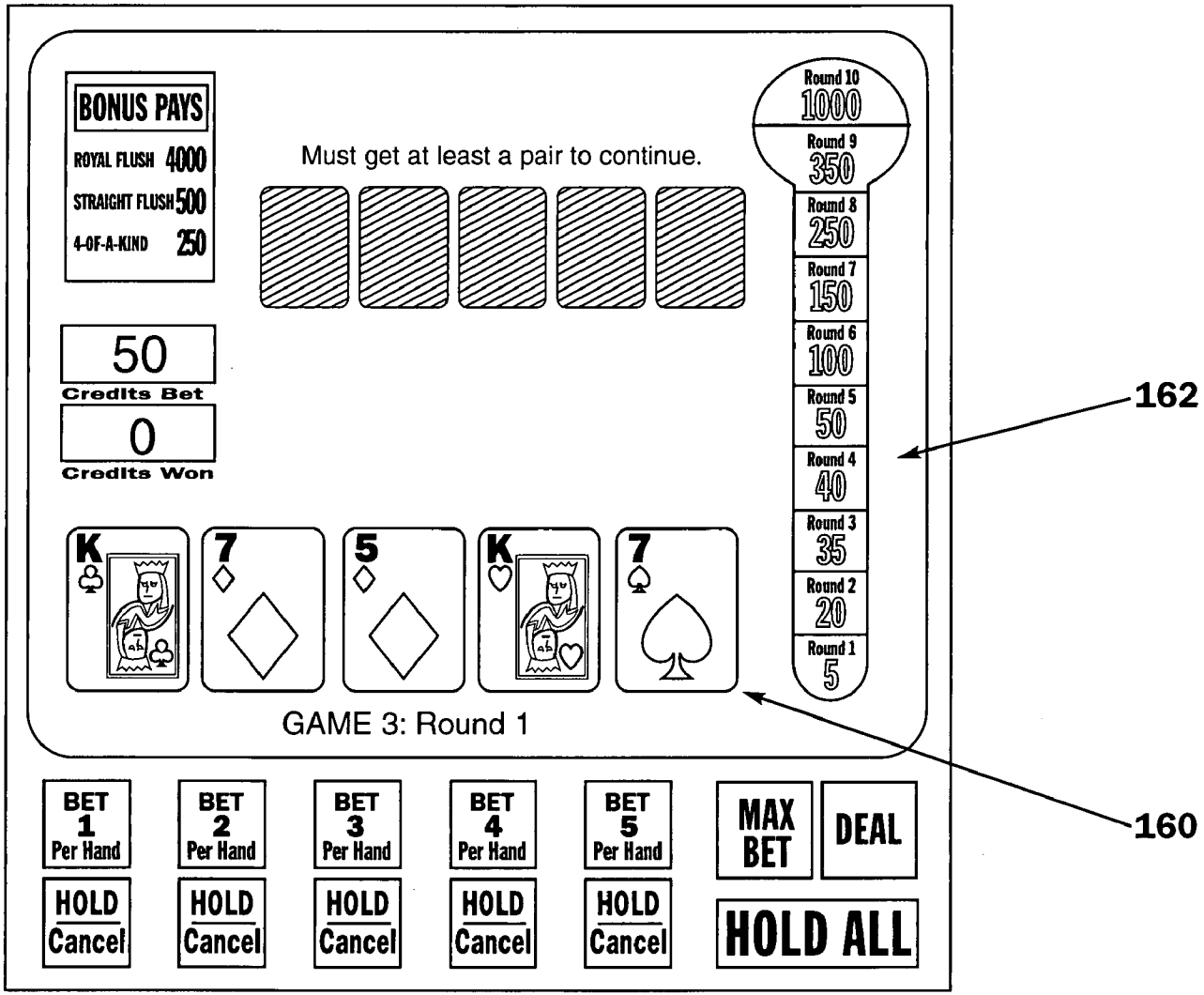
Figure 20:
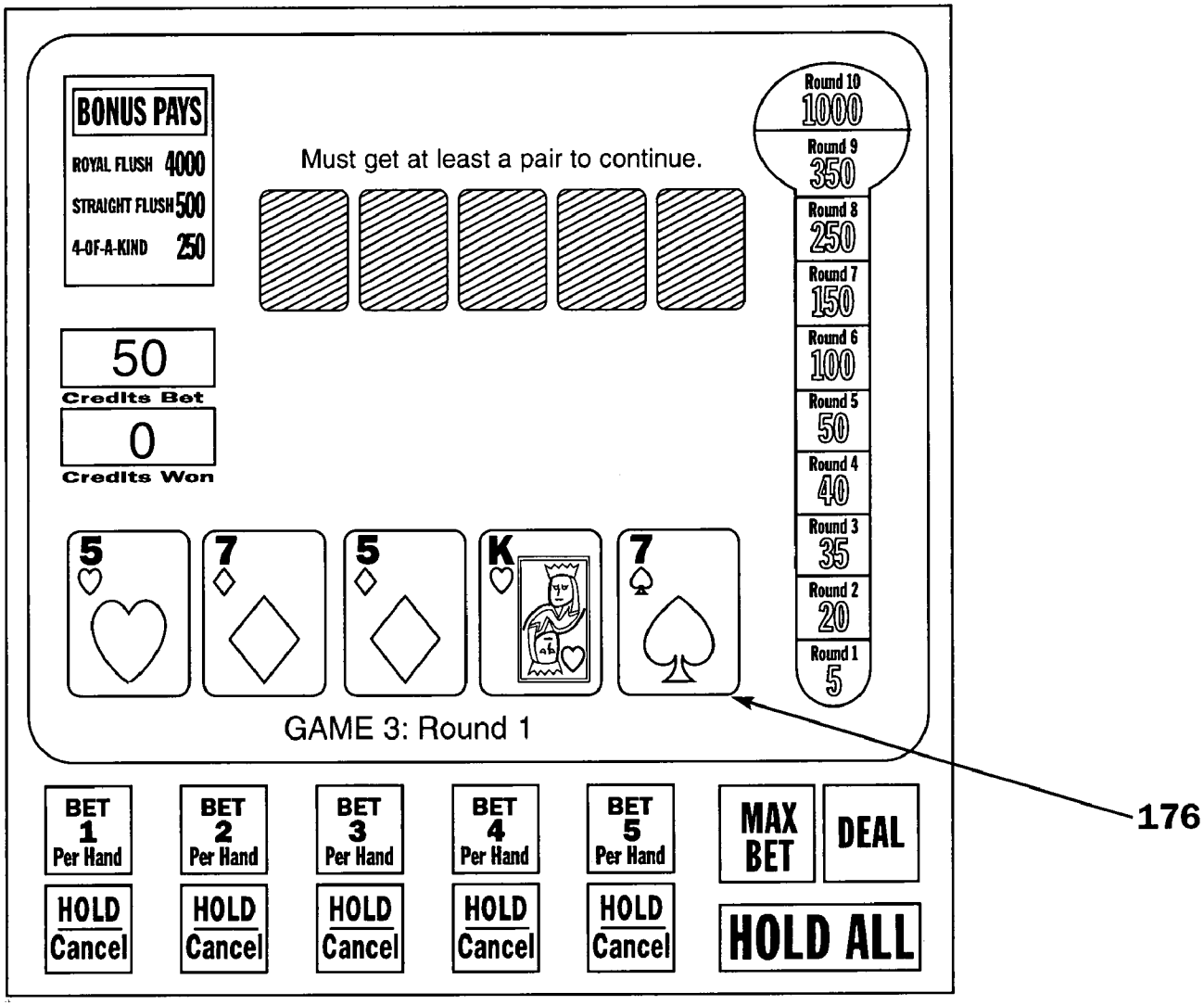
Figure 21:
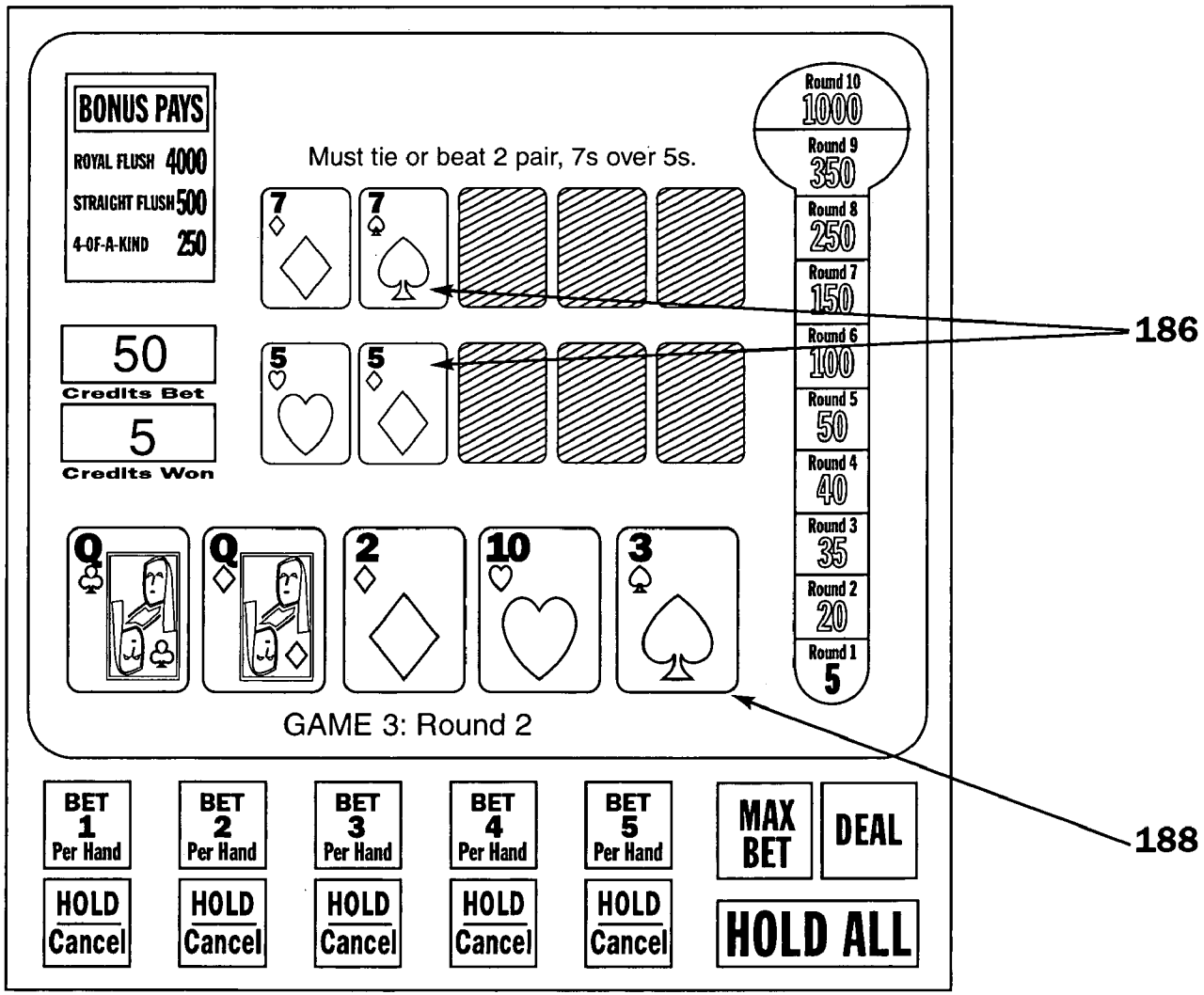
Figure 22:
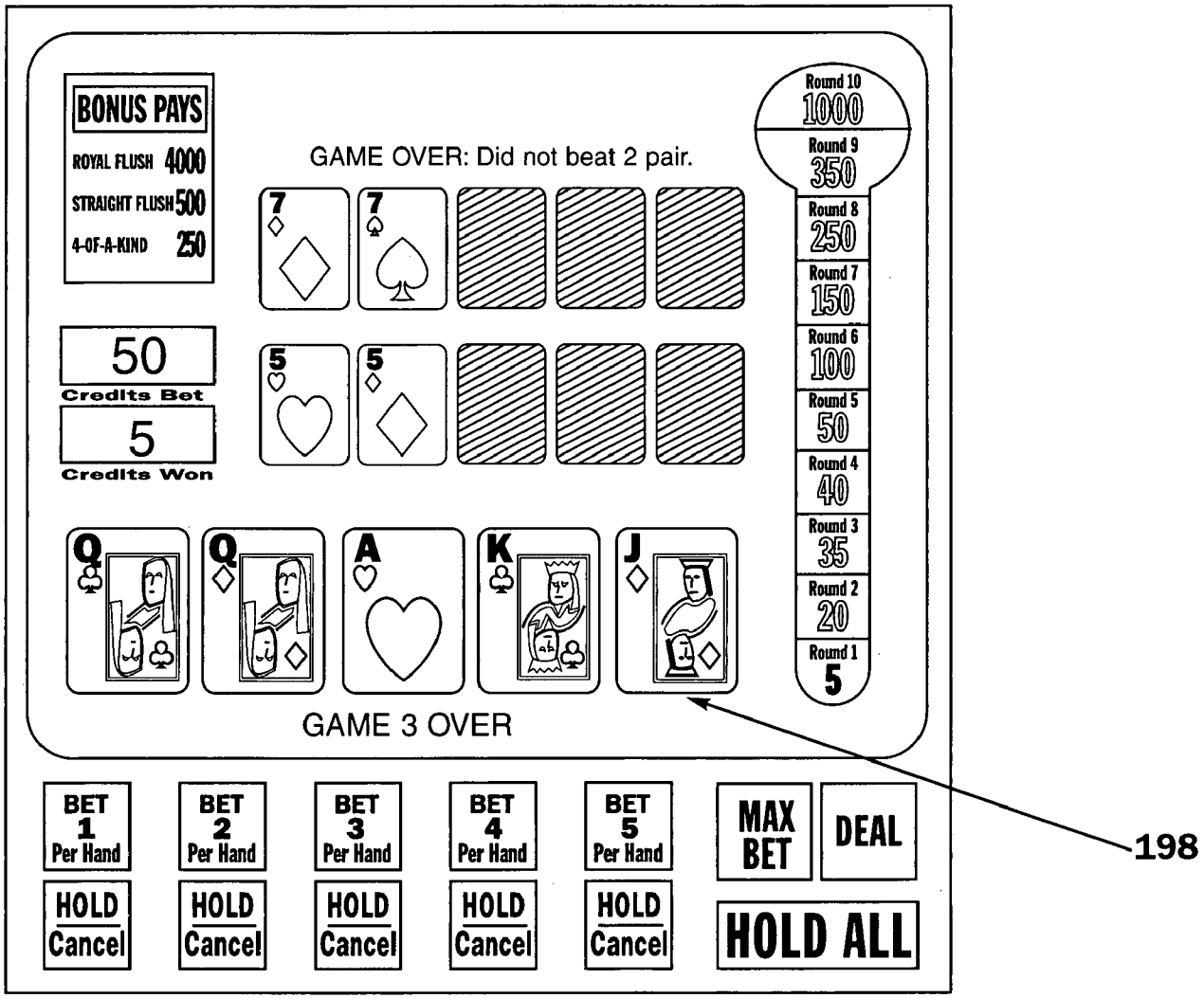

Another strategy is shown in FIG. 19, wherein a maximum wager has been placed and the initial hand 160 on the screen 162 is Two Pair. The player would elect to keep the lower of the pairs (discarding the pair of Kings) to establish the new Target Rank, the results of the strategy being the two pair shown as final hand 176 in FIG. 20. In FIG. 21, the Target Rank 186 is shown on two lines for clarity and the new hand 188 is shown. The resulting play in FIG. 22 is a losing hand 198.

Wagers may also be altered between play of hands and hand sequences, usually only by lowering the amount of an additional wager, if allowed, so that if wagers continue to be at risk or if additional bonus amounts are offered, the player can be assured of some significant win, yet have the potential for a substantial win.

The alternative formats of play can be further described as a method of playing a sequence of rounds in a wagering game by a) placing a first bet to potentially play in a sequence of games on an undivided first bet. A sequence of bets is at least two or three rounds of hands being provided, theoretically up to hundreds of thousands of rounds, but effectively the number of rounds should be between 2–25, preferably between 3–35, between 2–20, between 3–20, between 2–15, between 3–15, or between 2–10 and between 3–10. Any partial portions of these ranges (e.g., 2–8, 3–17) may also be used. b) receiving a first set of symbols from which a rank may be determined in reading the symbols; c) determining the rank of the first set of symbols as a first rank, the game ordinarily ending if the first rank does not equal a predetermined rank and continuing to a following step d) if the first rank does exceed or equal the predetermined rank; d) receiving at least a second set of symbols from which a rank may be determined in reading the symbols; e) determining the rank of the second set of symbols; f) comparing the rank of the second set of symbols to the rank of the first set of symbols; g) determining whether the rank of said second set of symbols ties or exceeds the first rank; and h) resolving the first bet according to a paytable with respect to whether the second rank ties or exceeds the first rank. This method of play is based upon a single wager being placed, with the entire wager at play in each round of play, as opposed to wagering 2–25 equal bets at play at each round. After the first round of play (rank 2 being compared to rank 1), the method may continue with another sequence wherein after step h), i) receiving a third set of symbols from which a rank may be determined in reading the symbols; j) determining the rank of the third set of symbols as a third rank; k) comparing the rank of the third set of symbols to the rank of the second set of symbols; l) determining whether the rank of said third set of symbols ties or exceeds the second rank; and m) further resolving the first bet according to a paytable with respect to whether the third rank ties or exceeds the second rank. Similarly a fourth sequence may be played as wherein after step m), n) receiving a fourth set of symbols from which a rank may be determined in reading the symbols; o) determining the rank of the fourth set of symbols as a fourth rank; p) comparing the rank of the fourth set of symbols to the rank of the third set of symbols; q) determining whether the rank of said fourth set of symbols ties or exceeds the third rank; and r) further resolving the first bet according to a paytable with respect to whether the fourth rank ties or exceeds the third rank. When a hand of high rank selected from the group consisting of Four-of-a-Kind, Straight Flush and Royal Flush is achieved on any hand, a special bonus may be awarded the player. The special bonus may vary depending upon which hand in the sequence of rounds the high hand occurs.

Similarly in a method of playing a sequence of rounds in a wagering game, the game is played by a) placing an initial wager of at least a first bet to potentially play in a sequence of games on an undivided first bet. The initial wager may be a single wager, as described above or multiple wagers with portions at play in the play of the game sequences. b) receiving a first set of symbols from which a rank may be determined in reading the symbols; c) determining the rank of the first set of symbols as a first rank, the game ending if the first rank does not equal a predetermined rank and continuing to a following step d) if the first rank does exceed or equal the predetermined rank; d) receiving at least a second set of symbols from which a rank may be determined in reading the symbols; e) determining the rank of the second set of symbols; f) comparing the rank of the second set of symbols to the rank of the first set of symbols; g) determining whether the rank of said second set of symbols ties or exceeds the first rank; and h) resolving the at least a first bet according to a paytable with respect to whether the second rank ties or exceeds the first rank; wherein at any time after resolution of step h) the player is provided with an option to withdraw all or some of the initial wager, continuing the game with less than all of the initial wager if less than all of the initial wager is withdrawn.

Another game format would be as a method of playing a potential sequence of X rounds in a wagering game, where X is a whole integer of greater than or equal to 2 (e.g., the 2–25 described above). The game being played by a) placing an initial wager of at least a first bet to potentially play in a sequence of games on an undivided first bet; b) receiving a first set of symbols from which a rank may be determined in reading the symbols; c) determining the rank of the first set of symbols as a first rank, the game ending if the first rank does not equal a predetermined rank and continuing to a following step d) if the first rank does exceed or equal the predetermined rank; d) receiving at least a second set of symbols from which a rank may be determined in reading the symbols; e) determining the rank of the second set of symbols; f) comparing the rank of the second set of symbols to the rank of the first set of symbols; g) determining whether the rank of said second set of symbols ties or exceeds the first rank; and h) resolving the at least a first bet according to a paytable with respect to whether the second rank ties or exceeds the first rank. In playing the sequence of X rounds, when a rank of one hand fails to exceed a rank of a preceding hand, any remaining rounds up to at least the X rounds may be played according to steps b), c), d), e), f), g) and h) as if a first of the remaining rounds were a first round. The remaining rounds may be played with an effective bet that is different from the at least one first bet. For example, if the first bet were $10.00 placed on eight rounds and the comparison failed at the third round, a wager of $5.00 may continue on the remaining five rounds. Usually the effective bet is less than the at least one first bet.

Another format for playing a wagering game comprises a player placing an initial wager of at least one bet (again a single bet or multiple bets played in each round separately); the player receiving a first set of symbols from which a rank may be determined in reading the symbols; determining the rank of the first set of symbols as a first rank to see if the first rank equals or exceeds a first predetermined rank; if said first rank exceeds the first predetermined rank, the player receiving at least a second set of symbols from which a rank may be determined in reading the symbols; determining the rank of the second set of symbols; comparing the rank of the second set of symbols to the rank of the first set of symbols; determining whether the rank of said second set of symbols either ties or exceeds the first rank; resolving the at least one bet with respect to whether the second rank ties or exceeds the first rank, wherein, if the second rank does not exceed the first rank, providing a third set of symbols to be compared to a second predetermined rank that is higher than said first predetermined rank and comparing a third rank of the third set of symbols to the second predetermined rank and resolving at least a part of the initial wager against a paytable if the third rank exceeds the second rank. This type of format may also be played when the first hand does not meet a predetermined first rank that is ordinarily needed to continue play of the game sequences. For example, if the first predetermined rank is a pair of 2's and the rank, even after discard and replacement does not meet that rank, the game may be allowed to continue with at least one more round with a second predetermined rank provided that the second hand must equal or exceed for the game to continue, such as a pair of J's, Q's, K's, or Aces. That default second predetermined rank may also be played against a different paytable than the first round was played, usually at a lower payout rate. The same format can also be used when the second rank fails to exceed the first rank, even after the first hand qualifies. A third hand may be provided, and the rank that must be equaled or exceeded by the third rank may be required to be a second predetermined rank or the actual first rank, for example, whichever is higher or whichever is lower, or by any other selection method.

One skilled in the art would appreciate the equivalents and alternatives that could be practiced, yet remaining within the scope of the invention disclosed.

What is claimed is:

1. A method of playing a wagering game:

placing at least one bet;

a player receiving a first set of symbols from which a poker rank may be determined in reading the symbols;

determining the poker rank of the first set of symbols as a first poker rank;

the player receiving at least a second set of symbols from which a poker rank may be determined in reading the symbols;

determining the poker rank of the second set of symbols;

comparing the poker rank of the second set of symbols to the poker rank of the first set of symbols;

determining whether the poker rank of said second set of symbols ties or exceeds the first poker rank;

resolving the at least one bet with respect to whether the second poker rank ties or exceeds the first poker rank.

2. The method of claim 1 wherein receiving the first set of symbols comprises receiving a first initial set of symbols and having the option of discarding all or less than all of the symbols and replacing discarded symbols to provide the first poker rank, and the at least a second set of symbols is received only when the first poker rank equals or exceeds a predetermined U poker rank.

3. The method of claim 2 wherein receiving the second set of symbols comprises receiving a second initial set of symbols and having the option of discarding all or less than all of the symbols and replacing discarded symbols to provide the second poker rank.

4. The method of claim 1 wherein after resolving the at least one bet, the second poker rank becomes a base poker rank in a next round of play of receiving a third set of symbols and comparing a poker rank for the third set of symbols to the second poker rank, wherein if the third poker rank ties or exceeds the second poker rank, resolving the at least one bet with respect to at least one of whether the third poker rank ties or exceeds the second poker rank and b) how many consecutive rounds have been played where a present hand poker rank has exceeded a previous hand poker rank.

5. A method of playing a sequence of rounds in a wagering game:

a) a player placing a first bet to play in a sequence of games on an undivided first bet;

b) the player receiving a first set of symbols from which a poker rank may be determined in reading the symbols;

c) determining the rank of the first set of symbols as a first poker rank, the game ending if the first poker rank does not equal a predetermined poker rank and the game continuing to a following step d) if the first poker rank does exceed or equal the predetermined poker rank;

d) the player receiving at least a second set of symbols from which a poker rank may be determined in reading the symbols;

e) determining the poker rank of the second set of symbols;

f) comparing the poker rank of the second set of symbols to the rank of the first set of symbols;

g) determining whether the poker rank of said second set of symbols ties or exceeds the first poker rank; and h) resolving the first bet according to a paytable with respect to whether the second poker rank ties or exceeds the first poker rank.

6. The method of claim 5 wherein after step h), i) receiving a third set of symbols from which a poker rank may be determined in reading the symbols; j) determining the poker rank of the third set of symbols as a third poker rank; k) comparing the poker rank of the third set of symbols to the poker rank of the second set of symbols; 1) determining whether the poker rank of said third set of symbols ties or exceeds the second poker rank; and m) further resolving the first bet according to a paytable with respect to whether the third poker rank ties or exceeds the second poker rank.

7. The method of claim 6 wherein after step in), n) receiving a fourth set of symbols from which a poker rank may be determined in reading the symbols; o) determining the poker rank of the fourth set of symbols as a fourth poker rank; p) comparing the poker rank of the fourth set of symbols to the poker rank of the third set of symbols; q) determining whether the rank of said fourth set of symbols ties or exceeds the third poker rank; and r) further resolving the first bet according to a paytable with respect to whether the fourth rank ties or exceeds the third poker rank.

8. The method of claim 7 wherein when a hand of high poker rank selected from the group consisting of Four-of-a-Kind, Straight Flush and Royal Flush is achieved on any hand, a special bonus is awarded the player.

9. The method of claim 8 wherein the special bonus varies depending upon which hand in the sequence of rounds the high hand occurs.

10. A method of playing a sequence of rounds in a wagering game:

a) placing an initial wager of at least a first bet to play in a sequence of games on an undivided first bet;

b) receiving a first set of symbols from which a poker rank may be determined in reading the symbols to determine a poker rank;

c) determining the rank of the first set of symbols as a first poker rank, the game ending if the first poker rank does not equal a predetermined poker rank and continuing to a following step d) if the first poker rank does exceed or equal the predetermined poker rank; d) receiving at least a second set of symbols from which a poker rank may be determined in reading the symbols;

e) determining the poker rank of the second set of symbols;

f) comparing the poker rank of the second set of symbols to the poker rank of the first set of symbols;

g) determining whether the poker rank of said second set of symbols ties or exceeds the first poker rank; and h) resolving the at least a first bet according to a paytable with respect to whether the second poker rank ties or exceeds the first poker rank;

wherein at any time after resolution of step h) when the second rank ties or exceeds the first poker rank, the player is provided with an option to withdraw all or some of the initial wager, continuing the sequence of rounds in which consecutive poker ranks are compared with less than all of the initial wager if less than all of the initial wager is withdrawn.

11. The method of claim 10 wherein when a hand of high poker rank selected from the group consisting of Four-of-a-Kind, Straight Flush and Royal Flush is achieved on any hand, a special bonus is awarded the player.

12. The method of claim 11 wherein the special bonus varies depending upon which hand in the sequence of rounds the high hand occurs.

13. A method of playing a potential sequence of X rounds in a wagering game, where X is a whole integer of greater than 2:

a) placing an initial wager of at least a first bet to play in a sequence of games on an undivided first bet;

b) receiving a first set of symbols from which a poker rank may be determined in reading the symbols;

c) determining the poker rank of the first set of symbols as a first poker rank, the game ending if the first poker rank does not equal a predetermined poker rank and continuing to a following step d) if the first poker rank does exceed or equal the predetermined poker rank;

d) receiving at least a second set of symbols from which a poker rank may be determined in reading the symbols;

e) determining the poker rank of the second set of symbols;

f) comparing the poker rank of the second set of symbols to the poker rank of the first set of symbols;

g) determining whether the poker rank of said second set of symbols ties or exceeds the first poker rank; and h) resolving the at least a first bet according to a paytable with respect to whether the second poker rank ties or exceeds the first poker rank;

wherein when in playing the sequence of X rounds, when a poker rank of one hand in a subsequent round fails to exceed a poker rank of a preceding hand, any remaining rounds up to at least the X rounds may be played according to steps b), c), d), e), f), g) and h) as if a first of the remaining rounds were a first round.

14. The method of claim 13 wherein the remaining rounds are played with an effective bet that is different from the at one first bet.

15. The method of claim 14 wherein the effective bet is less than the at least one first bet.

16. A method of playing a wagering game:

a player placing an initial wager of at least one bet;

the player receiving a first set of symbols from which a poker rank may be determined in reading the symbols;

determining the poker rank of the first set of symbols as a first poker rank to see if the first poker rank equals or exceeds a first predetermined poker rank;

if said first poker rank exceeds the first predetermined poker rank, the player receiving at least a second set of symbols from which a poker rank may be determined in reading the symbols; determining the poker rank of the second set of symbols;

comparing the poker rank of the second set of symbols to the poker rank of the first set of symbols;

determining whether the poker rank of said second set of symbols either ties or exceeds the first poker rank;

resolving the at least one bet with respect to whether the second poker rank ties or exceeds the first poker rank, wherein, if the second poker rank does not exceed the first poker rank, providing a third set of symbols to be compared to a second predetermined poker rank that is higher than said first predetermined poker rank and comparing a third poker rank of the third set of symbols to the second predetermined poker rank and resolving at least a part of the initial wager against a paytable if the third poker rank exceeds the second poker rank.

* * * * *

UNITED STATES PATENT AND TRADEMARK OFFICE

CERTIFICATE OF CORRECTION

PATENT NO. : 7,059,965 B2
APPLICATION NO. : 10/821637
DATED : June 13, 2006
INVENTOR(S) : Kathleen Nylund Jackson It is certified that error appears in the above-identified patent and that said Letters Patent is hereby corrected as shown below:

In the specification, the first paragraph after the title should appear as follows:

PRIORITY CLAIM

This application is a non-provisional of, claims priority to and the benefit of U.S. Provisional Application No. 60/525,324, filed November 26, 2003.

Signed and Sealed this

Seventeenth Day of June, 2008

JON W. DUDAS
*Director of the United States Patent and Trademark Office*